US007412863B2

(12) United States Patent
Akami et al.

(10) Patent No.: US 7,412,863 B2
(45) Date of Patent: Aug. 19, 2008

(54) WORK POSITIONING DEVICE

(75) Inventors: Ichio Akami, Kanagawa (JP); Koichi Ishibashi, Kanagawa (JP); Teruyuki Kubota, Kanagawa (JP); Tetsuaki Kato, Kanagawa (JP); Jun Sato, Kanagawa (JP); Tetsuya Takahashi, Kanagawa (JP)

(73) Assignee: Amada Co., Ltd., Kanagawa (JP)

( * ) Notice: Subject to any disclaimer, the term of this patent is extended or adjusted under 35 U.S.C. 154(b) by 195 days.

(21) Appl. No.: 10/480,806

(22) PCT Filed: Jun. 18, 2002

(86) PCT No.: PCT/JP02/06036

§ 371 (c)(1),
(2), (4) Date: Apr. 28, 2004

(87) PCT Pub. No.: WO03/000439

PCT Pub. Date: Jan. 3, 2003

(65) Prior Publication Data

US 2004/0206145 A1 Oct. 21, 2004

(30) Foreign Application Priority Data

| | | |
|---|---|---|
| Jun. 20, 2001 | (JP) | 2001-185958 |
| Sep. 14, 2001 | (JP) | 2001-280498 |
| Feb. 26, 2002 | (JP) | 2002-049170 |
| May 31, 2002 | (JP) | 2002-158700 |

(51) Int. Cl.

| | |
|---|---|
| ***B21D 5/04*** | (2006.01) |
| ***G06K 9/00*** | (2006.01) |
| *B21D 11/22* | (2006.01) |
| *B21C 51/00* | (2006.01) |
| *B21J 13/10* | (2006.01) |

(52) U.S. Cl. ..... 72/31.11; 72/17.3; 72/31.12; 72/389.1; 72/389.3; 72/419; 72/461; 901/6; 901/15; 901/46; 901/47; 700/229; 700/259; 198/468.2; 198/468.4; 414/225.01; 414/627; 414/781; 414/784; 414/749.1

(58) Field of Classification Search ..... 72/17.3, 72/31.12, 389.1, 389.3, 419, 420, 422, 428, 72/461, 31.1, 31.11; 901/6, 15, 46, 47; 700/229, 700/259; 198/468.2, 468.4; 414/225.01, 414/627, 781, 783, 784, 749.1, 751.1, 752.1
See application file for complete search history.

(56) References Cited

U.S. PATENT DOCUMENTS 4,772,801 A * 9/1988 Fornerod et al. ..... 72/389.3

(Continued)

FOREIGN PATENT DOCUMENTS

JP 59-227379 12/1984

(Continued)

OTHER PUBLICATIONS

English Language Abstract of JP 5-131334.

(Continued)

*Primary Examiner*—David B Jones
(74) *Attorney, Agent, or Firm*—Greenblum & Bernstein, P.L.C.

(57) ABSTRACT

Regarding predetermined positioning criteria ($M_1$, $M_2$), (($G_1$, $G_2$), ($N_1$, or $N_2$), ($K_1$, $K_2$)), there is provided image processing means (40B) for obtaining by image processing, measured values ($C_{D1}$, $C_{D2}$) (($G_{D1}$, $G_{D2}$), ($N_{D1}$, or $N_{D2}$), ($K_{D1}$, $K_{D2}$)) and reference values ($C_{R1}$, $C_{R2}$) (($G_{R1}$, $G_{R2}$), ($N_{R1}$, or $N_{R2}$), ($K_{R1}$, $K_{R2}$)), and for moving a work (W) in a manner that the measured values ($C_{D1}$, $C_{D2}$) (($G_{D1}$, $G_{D2}$), ($N_{D1}$, or $N_{D2}$), ($K_{D1}$, $K_{D2}$)) and the reference values ($C_{R1}$, $C_{R2}$) (($G_{R1}$, $G_{R2}$), ($N_{R1}$, or $N_{R2}$), ($K_{R1}$, $K_{R2}$)) coincide with each other, thereby positioning the work (W) at a predetermined position.

10 Claims, 26 Drawing Sheets

U.S. PATENT DOCUMENTS

| | | | | | |
|---|---|---|---|---|---|
| 5,187,958 | A | | 2/1993 | Prunotto et al. | |
| 5,531,087 | A | * | 7/1996 | Kitabayashi et al. | 72/37 |
| 5,661,671 | A | * | 8/1997 | Ooenoki et al. | 703/7 |
| 5,698,847 | A | * | 12/1997 | Yoda et al. | 250/225 |
| 5,748,854 | A | * | 5/1998 | Watanabe et al. | 700/258 |
| 5,761,940 | A | * | 6/1998 | Moore et al. | 72/19.4 |
| 5,839,310 | A | * | 11/1998 | Tokai et al. | 72/31.1 |
| 5,971,130 | A | | 10/1999 | Nakamura | |
| 5,987,958 | A | * | 11/1999 | Moore et al. | 72/422 |
| 6,341,243 | B1 | | 1/2002 | Bourne et al. | |
| 6,644,080 | B2 | * | 11/2003 | Lindstrom | 72/19.4 |
| 6,722,178 | B1 | * | 4/2004 | Ito et al. | 72/420 |
| 6,816,755 | B2 | * | 11/2004 | Habibi et al. | 700/259 |
| 6,938,454 | B2 | * | 9/2005 | Strasser et al. | 72/420 |
| 7,055,355 | B2 | * | 6/2006 | Codatto | 72/31.11 |
| 7,065,241 | B2 | * | 6/2006 | Lehner et al. | 382/152 |

FOREIGN PATENT DOCUMENTS

| | | |
|---|---|---|
| JP | 1-197087 | 8/1989 |
| JP | 2-284721 | 11/1990 |
| JP | 5-131334 | 5/1993 |
| JP | 5-63806 | 9/1993 |

OTHER PUBLICATIONS

English Language Abstract of JP 1-197087.
English Language Abstract of JP 2-284721.

* cited by examiner

[POSITIONING CRITERIA]

(A)

(B)

(C)

(D)

(A)

(B)

WORK POSITIONING DEVICE

TECHNICAL FIELD

The present invention relates to a work positioning device, and in particular to a work positioning device which positions a work at a predetermined position by image processing.

BACKGROUND ART

Conventionally, a bending machine such as a press brake (FIG. 25(A)) comprises a punch P mounted on an upper table 52 and a die D mounted on a lower table 53, and moves either one of the tables upward or downward to bend a work W by cooperation of the punch P and die D.

In this case, before the bending operation, the work W is positioned at a predetermined position by being butted on a butting face 50 which is set behind the lower table 53.

In a case where an automatic bending operation is carried out with the use of a robot, the work W is positioned by a gripper 51 of the robot supporting the work W to place the work W on the die D and butt the work W on the butting face 50.

In order to bend a work W having its C portion forming-processed as shown in FIG. 25(B), one end A of the work W is supported by the gripper 51 of the robot, and the other end B is butted on the butting face 50.

However, in this case, the portion of the work W between the other end B and the portion placed on the die D is mildly curved as shown in FIG. 25(A).

Accordingly, the butting of the work W against the butting face 50 by the gripper 51 of the robot becomes very unstable, making it impossible to achieve accurate positioning. If a human worker determines the position of the work W by holding the work W, accurate positioning might be available due to the worker's sense developed over years. However, a robot can not achieve accurate positioning by trial and error.

Further, in a case where a corner of a work W is to be bent along a bending line m as shown in FIG. 26(A), positioning of the work W can not be carried out by butting the work W on the butting face 50. Furthermore, in a case where the bending line m and a work end surface T are not parallel with each other as shown in FIG. 26(B), the positioning accuracy might be lowered even if the work W is butted on the butting face 50. The intended bending operation can not be performed in either case.

An object of the present invention is to position a work accurately by carrying out electronic positioning by using image processing, even in a case where mechanical positioning by using a butting face is impossible.

DISCLOSURE OF INVENTION

According to the present invention, regarding predetermined positioning criteria $M_1$, $M_2$, (($G_1$, $G_2$), ($N_1$, or $N_2$), ($K_1$, $K_2$)), there is provided, as shown in FIG. 1, image processing means (40B) for obtaining by image processing, measured values $C_{D1}$, $C_{D2}$ (($G_{D1}$, $G_{D2}$), ($N_{D1}$, or $N_{D2}$), ($K_{D1}$, $K_{D2}$)) and reference values $C_{R1}$, $C_{R2}$ (($G_{R1}$, $G_{R2}$). ($N_{R1}$, or $N_{R2}$), ($K_{R1}$, $K_{R2}$)), and for moving a work (W) in a marker that the measured values $C_{D1}$, $C_{D2}$ (($G_{D1}$, $G_{D2}$), ($N_{D1}$, or $N_{D2}$), ($K_{D1}$, $K_{D2}$)) and the reference values $C_{R1}$, $C_{R2}$ (($G_{R1}$, $G_{R2}$), ($N_{R1}$, or $N_{R2}$), ($K_{R1}$, $K_{R2}$)) coincide with each other, thereby positioning the work (W) at a predetermined position.

According to the above structure of the present invention, if it is assumed that the predetermined positioning criteria are, for example, holes $M_1$ and $M_2$ (FIG. 2(A)) formed in a work W, outlines $G_1$ and $G_2$ (FIG. 2(B)), of a work W, a corner $N_1$ or $N_2$ (FIG. 2(C)) of a work W, or distances $K_1$ and $K_2$ (FIG. 2(D)) between positions of edges of butting faces 15 and 16 and predetermined positions on a work end surface T, a work W supported by a robot 13 can be automatically moved and positioned at a predetermined position by driving the robot 13 via, for example, robot drive means 40C in a manner that measured values $C_{D1}$ and $C_{D2}$ (($G_{D1}$, $G_{D2}$), ($N_{D1}$, or $N_{D2}$) ($K_{D1}$, $K_{D2}$)) which are obtained for the above kinds of positioning criteria by image processing via work photographing means 12 and reference values $C_{R1}$ and $C_{R2}$ (($G_{R1}$, $G_{R2}$), ($N_{R1}$, or $N_{R2}$), ($K_{R1}$, $K_{R2}$)) which are obtained by image processing via information (CAD information or the like) coincide with each other.

Or in a case where the holes $M_1$ and $M_2$ (FIG. 2(A)) as the positioning criteria are quite simple square holes (for example, holes of regular squares), if the measured values and the reference values are displayed on a screen 40D (FIG. 1), a human worker can position the work W at a predetermined position by seeing the screen 40D and manually moving the work W in a manner that the measured values and the reference values coincide with each other.

As a first embodiment, the present invention specifically comprises, as shown in FIG. 3, work image detecting means 10D for detecting an image DW of a work W which is input from work photographing means 12 attached to a bending machine 11, work reference image calculating means 10E for calculating a reference image RW of the work W based on pre-input information, difference amount calculating means 10F for comparing the detected image DW and the reference image RW and calculating an amount of difference between them, and robot control means 10G for controlling a robot 13 such that the detected image DW and the reference image RW coincide with each other based on the amount of difference and thereby positioning the work W at a predetermined position.

Therefore, according to the first embodiment of the present invention, by providing, for example, positioning marks $M_1$ and $M_2$ constituted by holes at predetermined positions apart from a bending line m on the work W (FIG. 4) as the positioning criteria, the difference amount calculating means 10F (FIG. 3) can compare detected positioning marks $M_{D1}$ and $M_{D2}$ (FIG. 5(A)) in the detected image DW and reference positioning marks $M_{R1}$ and $M_{R2}$ in the reference image RW, and calculate amounts of difference $\Delta\theta=\theta_0-\theta_1$ (FIG. 5(A)), $\Delta x=x_1-x_1'$ ($=x_2-x_2'$) (FIG. 5(B)), and $\Delta y=y_1-y_1'$ ($y_2-y_2'$) in two-dimensional coordinates, regarding positions of centers of gravity of both kinds of the marks.

Or, according to another example of the first embodiment of the present invention, with the use of, for example, outlines $G_1$ and $G_2$ (FIG. 9) of the work W as the positioning criteria, the difference amount calculating means 10F (FIG. 3) can compare detected work outlines $G_{D1}$ and $G_{D2}$ in the detected image DW (FIG. 11(A)) and reference work outlines $G_{R1}$ and $G_{R2}$ in the reference image RW, and calculate amounts of difference $\Delta\theta=\tan^{-1}(D_2/L_2)$ (FIG. 11(A)), $\Delta x=U_x+T_x$ (FIG. 11(B)), and $\Delta y=U_y-T_y$ in two-dimensional coordinates.

Further, according to yet another example of the first embodiment of the present invention, with the use of, for example, a corner $N_1$ or $N_2$ (FIG. 12) as the positioning criterion, the difference amount calculating means 10F (FIG. 3) can compare only one detected corner $N_{D2}$ in the detected image DW (FIG. 13(A)) and only one corresponding reference corner $N_{R2}$ in the reference image RW, and calculate amounts of difference $\Delta\theta$ (FIG. 13(A)), $\Delta x$ (FIG. 13(B)), and $\Delta y$ in two-dimensional coordinates.

Accordingly, the Work W can be positioned at a predetermined position by the robot control means 10G converting the amounts of difference into correction drive signals $S_a$, $S_b$, $S_c$, $S_d$, and $S_e$ so that the robot control means 10G can position the bending line m of the work W right under a punch P via the robot 13.

Further, as a second embodiment, the present invention specifically comprise, as shown in FIG. 15, distance detecting means 30D for detecting distances $K_{D1}$ and $K_{D2}$ between positions $B_{R1}$ and $B_{R2}$ of the edges of the butting faces 15 and 16 and predetermined positions $A_{D1}$ and $A_{D2}$ on a work end surface $T_D$ based on a work image DW input from work photographing means 12 attached to the bending machine 11, reference distance calculating means 30E for calculating by image processing, reference distances $K_{R1}$ and $K_{R2}$ between the preset positions $B_{R1}$ and $B_{R2}$ of the edges of the butting faces and predetermined positions $A_{R1}$ and $A_{R2}$ on a work end surface $T_R$, distance difference calculating means 30F for comparing the detected distances and the reference distances and calculating distance differences between them, and robot control means 30F for controlling a robot in a manner that the detected distances and the reference distances coincide with each other based on the distance differences and thereby positioning the work at a predetermined position.

According to the second embodiment, with the use of distances $K_1$ and $K_2$ (FIG. 16) between positions of the edges of the butting faces 15 and 16 and predetermined positions on a work end surface T as the positioning criteria, the distance difference calculating means 30F (FIG. 15) can take differences between detected distances $K_{D1}$ and $K_{D2}$ and reference distances $K_{R1}$ and $K_{R2}$, and calculate distance differences $\Delta y_1$ and $\Delta y_2$ (FIG. 18) in two-dimensional coordinates. In this case, in order that the position of the work W on the bending machine 11 (FIG. 15) may be fixed uniquely, it is necessary to pre-position the work W in a longitudinal direction (X axis direction). For this purpose, the left end (FIG. 24(B)) of the work W supported by a gripper 14 of the robot 13 is arranged at a position apart from a machine center MC by $X_1$, by moving the robot 13 by a predetermined distance $X_G=X_S-X_1$ with the use of, for example, a side gauge 18 (FIG. 24(A)).

Under this state, the work W can be positioned at a predetermined position by the robot control means 30F (FIG. 15) converting the distance differences $\Delta y_1$ and $\Delta y_2$ into correction drive signals $S_a$, $S_b$, $S_c$, $S_d$, and $S_e$ so that the robot control means 30F can position a bending line m of the work W right under a punch P via the robot 13.

Due to this, according to the present invention, in a bending machine, even in a case where mechanical positioning by using butting faces is impossible, a work can be accurately positioned by carrying out electronic positioning by using the above-described image processing.

BEST MODE FOR CARRYING OUT THE INVENTION

The present invention will now be explained with reference to the attached drawing in order to specifically explain the present invention.

Figure 1:
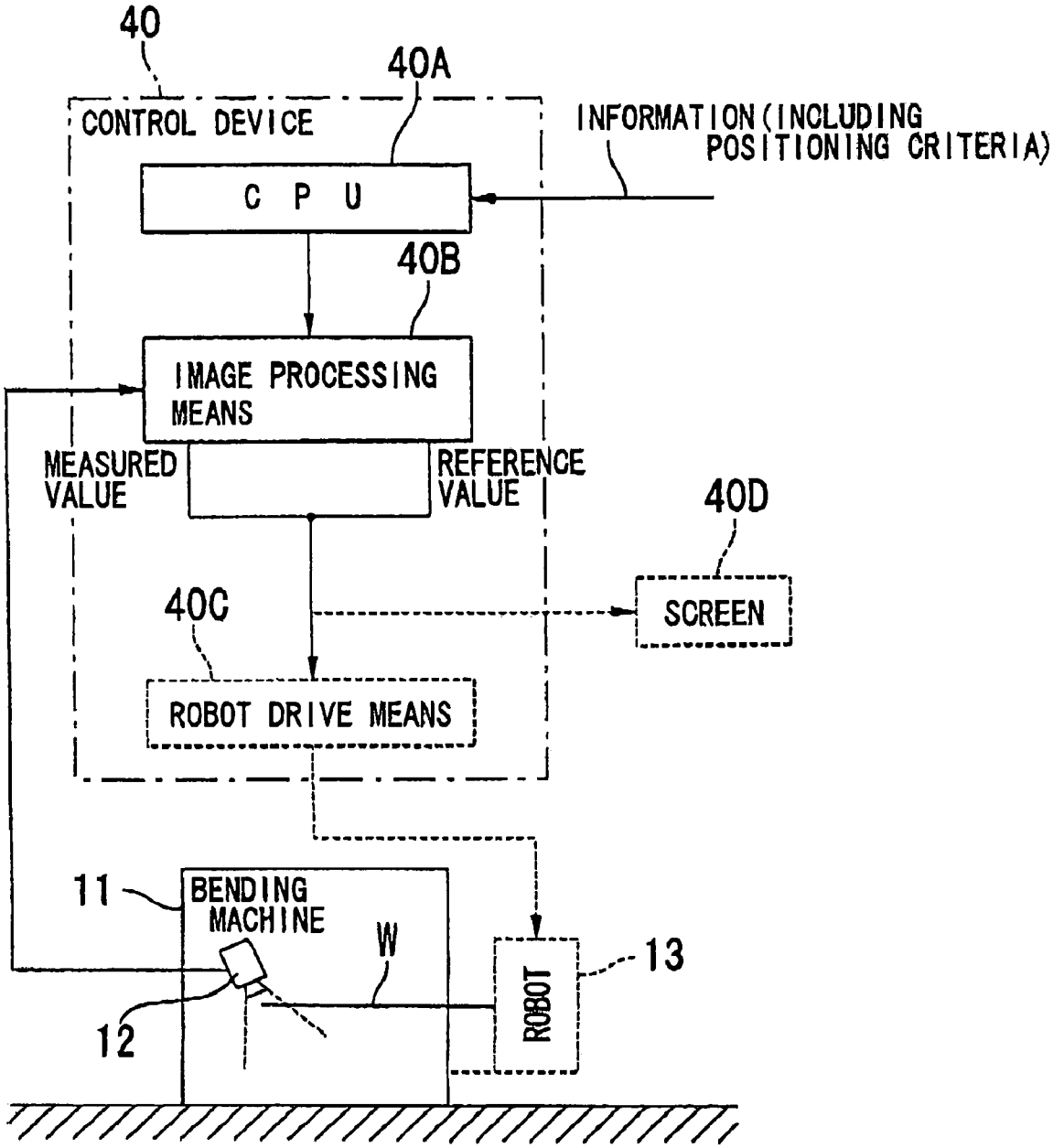
FIG. 1 is an entire view showing the structure of the present invention.
Figure 2:
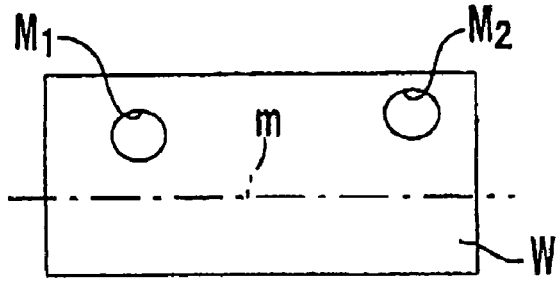
FIG. 2 are diagrams showing positioning criteria used in the present invention.
Figure 2:
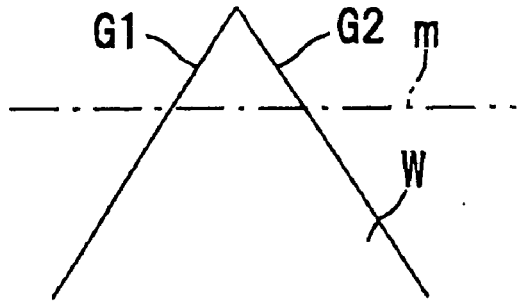
Figure 2:
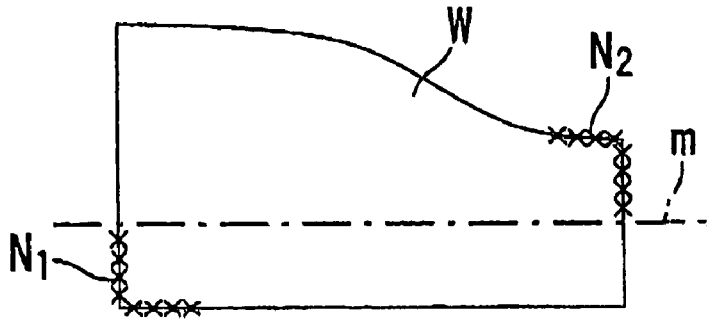
Figure 2:
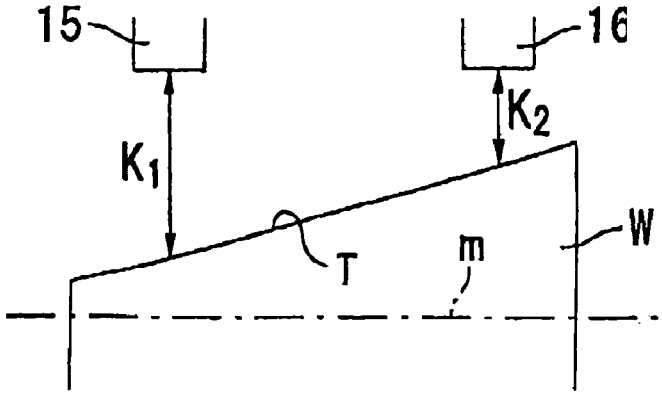
Figure 3:
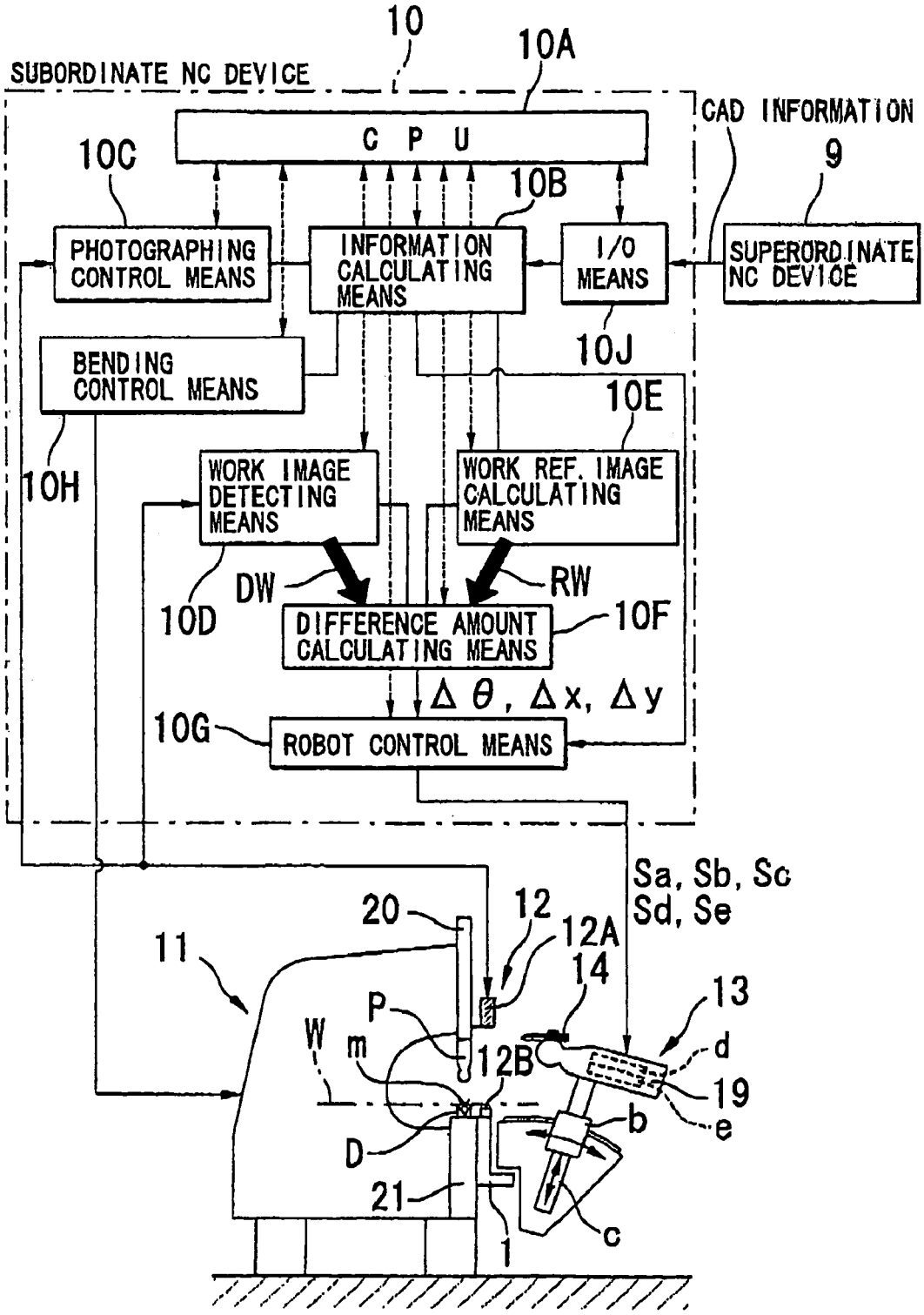
FIG. 3 is an entire view showing a first embodiment of the present invention.

FIG. 3 is an entire view showing a first embodiment of the present invention. In FIG. 3, a reference numeral 9 denotes a superordinate NC device, 10 denotes a subordinate NC device, 11 denotes a bending machine, 12 denotes work photographing means, and 13 denotes a robot.

Figure 6:
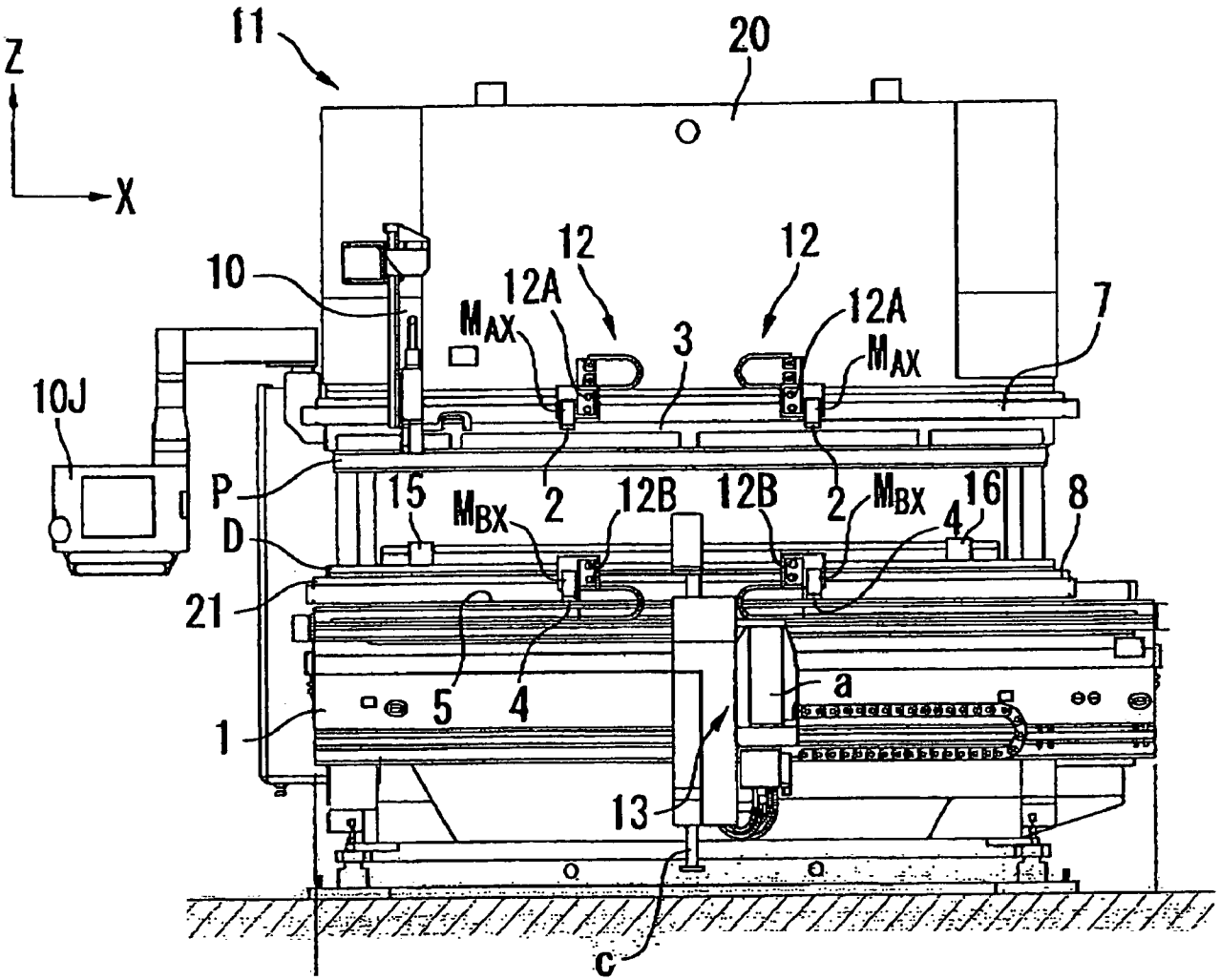
FIG. 6 is a front elevation of a bending machine 11 to which the first embodiment of the present invention is applied.
Figure 8:
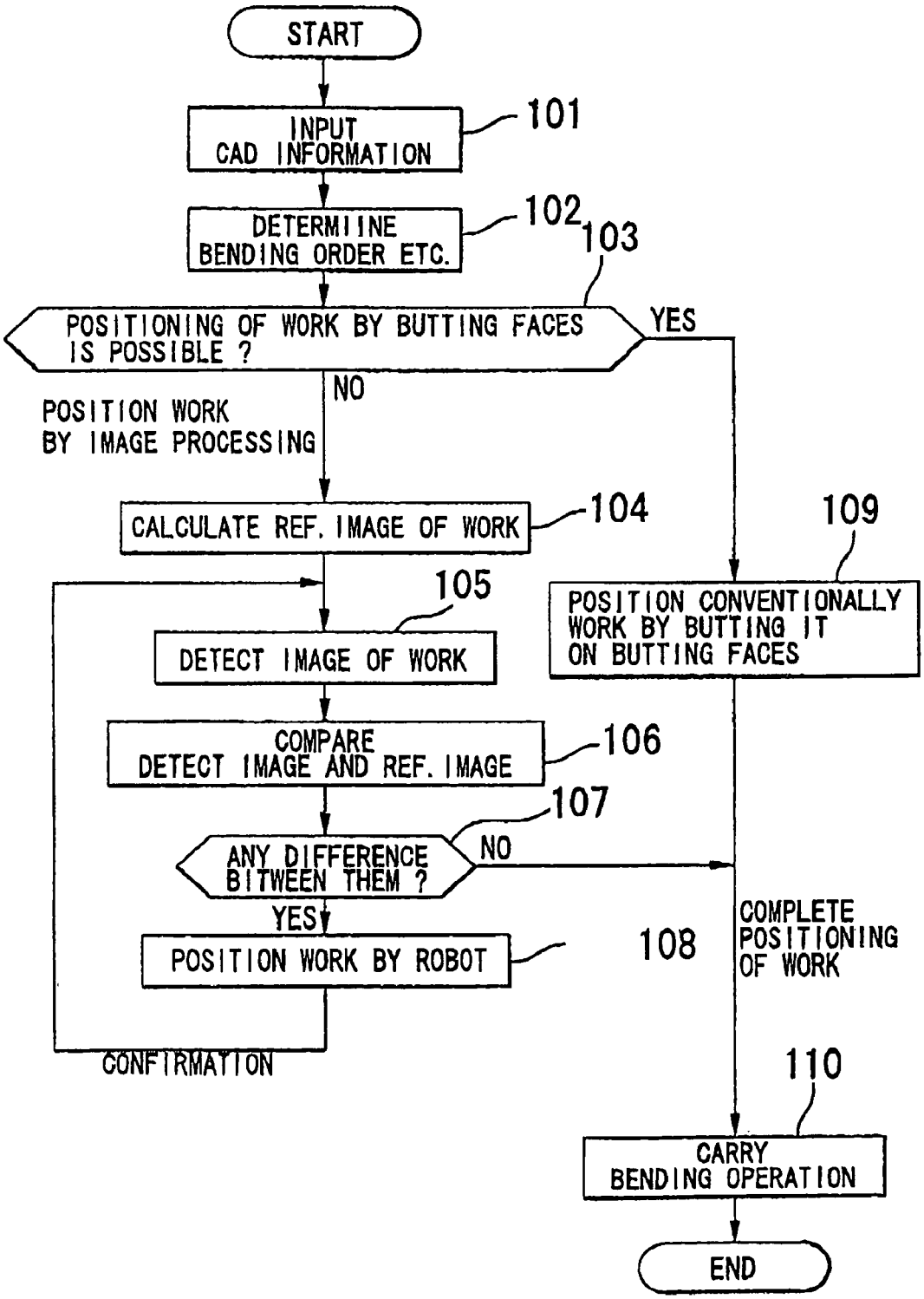
FIG. 8 is a flowchart for explaining an operation according to the first embodiment of the present invention.

With this structure, for example, CAD information is input from the superordinate NC device 9 to the subordinate NC device 10 which is a control device of the bending machine 11 (step 101 in FIG. 8), and the order of bending is determined (step 102 in FIG. 8). After this, in a case where positioning of a work W by butting faces 15 and 16 (FIG. 6) turns out to be impossible (step 103 in FIG. 8: NO), positioning of the work W is performed by image processing in the subordinate NC device 10 (for example, steps 104 to 108 in FIG. 8). Thereafter, bending is carried out (step 110 in FIG. 8).

In this case, a press brake can be used as the bending machine 11. As well known, a press brake comprises a punch P mounted on an upper table 20 and a die D mounted on a lower table 21, and carries out by the punch P and the die D, a predetermined bending operation on the work W which is positioned while being supported by a later-described gripper 14 of the robot 13.

The robot 13 is mounted on a base plate 1, and comprises a leftward/rightward direction (X axis direction) drive unit a, a forward/backward direction (Y axis direction) drive unit b, and an upward/downward direction drive unit c. The robot 13 comprises the aforementioned gripper 14 at the tip of its arm 19. The gripper 14 can rotate about an axis parallel with the X axis, and can also rotate about an axis parallel with a Z axis. Drive units d and e for such rotations are built in the arm 19.

With this structure, the robot 13 actuates each of the aforementioned drive units a, b, c, d, and e when correction drive signals $S_a$, $S_b$, $S_c$, $S_d$, and $S_e$ are sent from later-described robot control means 10G, so that control for making a detected image DW and a reference image RW coincide with each other will be performed (FIG. 5) and the work W will be positioned at a predetermined position.

The press brake (FIG. 6) is equipped with the work photographing means 12. The work photographing means 12 comprises, for example, a CCD camera 12A and a light source 12B therefor. The CCD camera 12A is attached near the upper table 20 for example, and the light source 12B is attached near the lower table 21 for example.

With this structure, the work W supported by the gripper 14 of the robot 13 is photographed by the CCD camera 12A, and the image of the work W is converted into a one-dimensional electric signal, and further converted by later-described work image detecting means 10D of the subordinate NC device 10 (FIG. 3) into a two-dimensional electric signal, thereby the detected image DW and the reference image RW are compared with each other (FIG. 5(A)) by difference amount calculating means 10F.

In this case, in order to photograph, for example, two positioning marks $M_1$ and $M_2$ (FIG. 4) provided on the work W as positioning criteria, the CCD camera 12A and its light source 12B are provided in pairs in a lateral direction. That is, holes $M_1$ and $M_2$ are bored through the work W (FIG. 4) at such predetermined positions apart from a bending line m as to cause no trouble in the bending operation on the work W, by using a punch press, a laser processing machine, or the like in a die cutting process before the bending operation by the press brake.

Or in a case where a great amount of bole information is included in CAD information, a human worker may arbitrarily designate and determine the positioning marks $M_1$ and $M_2$ on a development displayed on an operator control panel (10J) of the subordinate NC device 10.

As described above, the holes $M_1$ and $M_2$ (FIG. 4) are used as the positioning marks $M_1$ and $M_2$ which are examples of positioning criteria, to provide targets of comparison in a case where, as will be described later, the detected image DW of the work W and the reference image RW are compared (FIG. 5(A)) by the difference amount calculating means 10F (FIG. 3).

Consequently, the difference amount calculating means 10F calculates difference amounts of detected positioning marks $M_{D1}$ and $M_{D2}$ $\Delta\theta=\theta_0-\theta_1$ (FIG. 5(A)), $\Delta x=x_1-x_1'$ ($=x_2-x_2'$) (FIG. 5(B)), and $\Delta y=y_1-y_1'$ ($=y_2-y_2'$), with respect to reference positioning marks $M_{R1}$ and $M_{R2}$.

In this case, the positioning marks $M_1$ and $M_2$ (FIG. 4) provided on the work W are not necessarily symmetric, but are bored at such predetermined positions apart from the bending line m as to cause no trouble in the bending operation on the work W as described above. Accordingly, the CCD camera 12A and its light source 12B provided in pairs laterally can move pair by pair independently.

For example, one pair of CCD camera 12A and light source 12B move in the lateral direction (X axis direction) along X axis guides 7 and 8 by a mechanism constituted by a motor $M_{AX}$, a pinion 2, and a rack 3 and by a mechanism constituted by a motor $M_{BX}$, a pinion 4, and a rack 5 (FIG. 6), and move in the back and forth direction (Y axis direction) along a Y axis guide 17 by a mechanism constituted by a motor $M_{AY}$ and a ball screw 6 (FIG. 7), independently.

Figure 4:
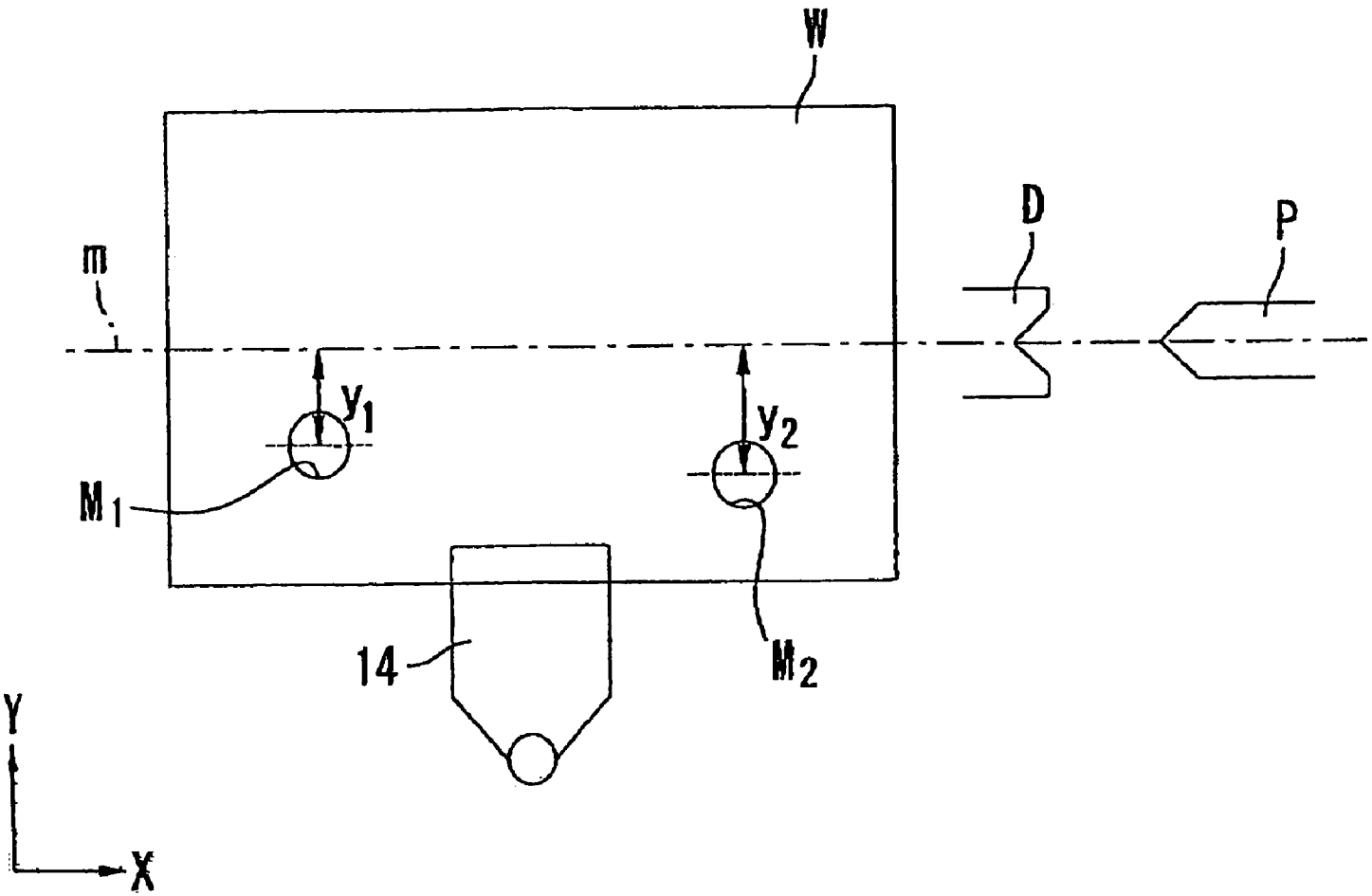
FIG. 4 is a diagram showing positioning marks $M_1$ and $M_2$ according to the first embodiment of the present invention.
Figure 14:
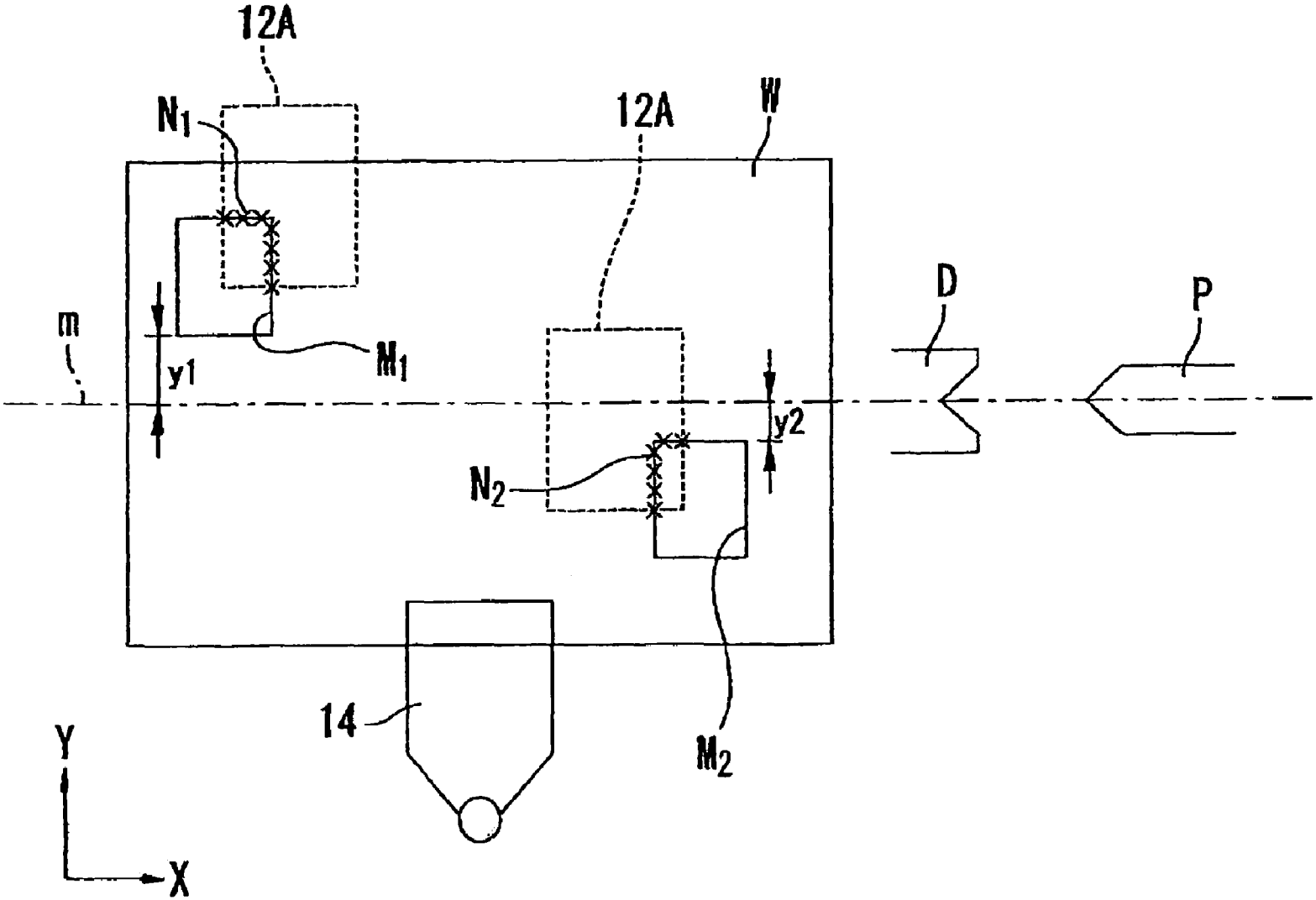
FIG. 14 is a diagram showing another example of FIG. 12.

In a case where the positioning marks $M_1$ and $M_2$ on the work W are not circular holes as shown in FIG. 4 but square holes, the detected image DW and the reference image RW can be compared even if there is only one positioning mark provided, as will be described later (FIG. 14). In this case, either one of the left and right pairs of CCD camera 12A and light source 12B are used.

Figure 7:
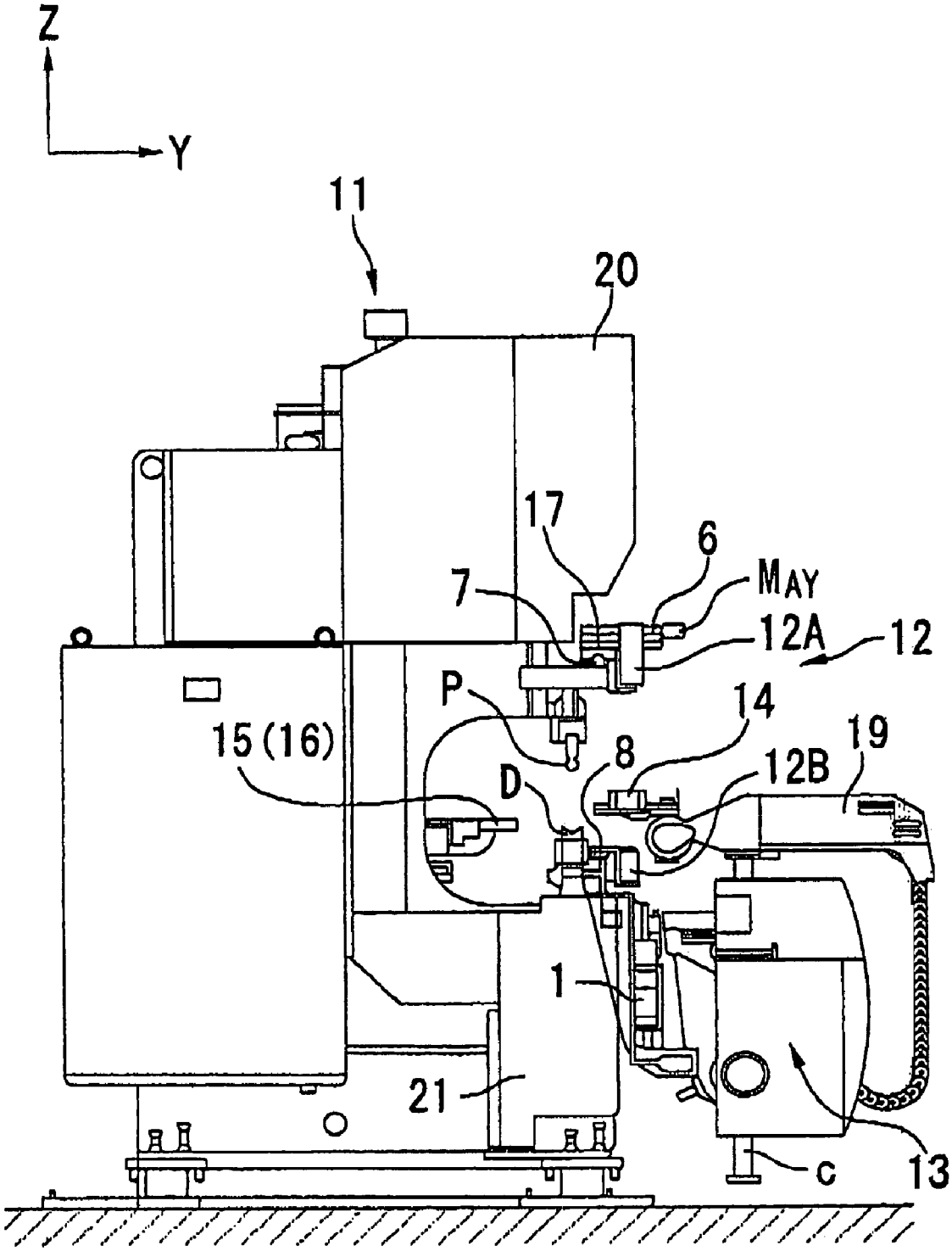
FIG. 7 is a side elevation of the bending machine 11 to which the first embodiment of the present invention is applied.

The butting faces 15 and 16 to be used in a case where the positioning of the work W is carried out in a conventional manner (step 103: YES, and step 109 in FIG. 8), are provided at the back of the lower table 21 constituting the press brake (FIG. 7).

The aforementioned superordinate NC device 9 (FIG. 3) and the subordinate NC device 10 are provided as the control devices for the press brake having the above-described structure. The superordinate NC device 9 is installed at an office or the like, and the subordinate NC device 10 is attached to a press brake (FIG. 6) in a plant or the like.

Of these devices, the superordinate NC 9 has CAD information stored therein. The stored CAD information contains work information such as plate thickness, material, length of bending line m (FIG. 4), and positions of positioning marks $M_1$ and $M_2$, etc. regarding a work W, and product information such as bending angle, etc. regarding a product. These information items are constructed as a three-dimensional diagram or a development.

The CAD information including these information items is input to the subordinate NC device 10 (step 101 in FIG. 8), to be used for, for example, positioning of the work W by image processing of the present invention.

The subordinate NC device 10 (FIG. 3) comprises a CPU 10A, information calculating means 10B, photographing control means 10C, work image detecting means 10D, work reference image calculating means 10E, difference amount calculating means 10F, robot control means 10G, bending control means 10H, and input/output means 10J.

The CPU 10A controls the information calculating means 10B, the work image detecting means 10D, etc. in accordance with an image processing program (corresponding to FIG. 8) of the present invention.

The information calculating means 10B determines information such as the order of bending, etc. necessary for positioning and bending of the work W, by calculation based on the CAD information input from the superordinate NC device 9 via the input/output means 10J to be described later (step 102 in FIG. 8).

The information determined by calculation of the information calculating means 10B includes, in addition to the order of bending, molds (punch P and die D) to be used, mold layout indicating which mold is arranged at which position on the upper table 20 and lower table 21, and a program of the movements of the robot 13 which positions and feeds the work W toward the press brake.

Due to this, it is determined, for example, whether positioning of the work W by the butting faces 15 and 16 is possible or not (step 103 in FIG. 8). In a case where it is determined as impossible (NO), positioning of the work W by using image processing of the present invention is to be performed (steps 104 to 108 in FIG. 8).

The photographing control means 10C performs control for moving the work photographing means 12 constituted by the aforementioned CCD camera 12A and light source 12B based on the order of bending, mold layout, positions of the positioning marks $M_1$ and $M_2$, etc. determined by the information calculating means 10B, and controls the photographing operation of the CCD camera 12A such as control of the view range (FIG. 5(A)).

The work image detecting means 10D (FIG. 3) converts an image of the work W including the positioning marks $M_1$ and $M_2$ which image is constituted by a one-dimensional electric signal sent from the work photographing means 12 into a two-dimensional electric signal, as described above.

Due to this, a detected image DW (FIG. 5(A)) of the work W is obtained. The positioning marks $M_1$ and $M_2$ (FIG. 4) on the work W are used as the targets of comparison with later-described reference positioning marks $M_{R1}$ and $M_{R2}$, as detected positioning marks $M_{D1}$ and $M_{D2}$ (FIG. 5(A)).

The positions of the centers $C_{D1}$ and $C_{D2}$ of gravity of the detected positioning marks $M_{D1}$ and $M_{D2}$ in two-dimensional coordinates will be represented herein as indicated below.

$$\text{Positions of centers of gravity } C_{D1}(x_1',y_1'),C_{D2}(x_2',y_2') \quad ①$$

The deflection angle $\theta_1$ of the detected positioning marks $M_{D1}$ and $M_{D2}$ can be represented as below based on ①.

$$\text{Deflection angle } \theta_1=\tan^{-1}\{(y_2'-y_1')/(x_2'-x_1')\} \quad ②$$

① and ② will be used when the difference amount calculating means 10F calculates a difference amount, as will be described later.

The work reference image calculating means 10E calculates a reference image RW including reference positioning marks $M_{R1}$ and $M_{R2}$ (FIG. 5(A)), based on the order of bending, mold layout, positions of the positioning marks $M_1$ and $M_2$ determined by the information calculating means 10B.

In this case, the positions of the centers $C_{R1}$ and $C_{R2}$ of gravity of the reference positioning marks $M_{R1}$ and $M_{R2}$ in two-dimensional coordinates will be likewise represented as below.

$$\text{Positions of centers of gravity } C_{R1}(x_1,y_1),C_{R2}(x_2,y_2) \quad ③$$

The deflection angle $\theta_0$ of the reference positioning marks $M_{R1}$ and $M_{R2}$ can be represented as below based on ③.

$$\text{Deflection angle } \theta_0=\tan^{-1}\{(y_2-y_1)/(x_2-x_1)\} \quad ④$$

③ And ④ will be likewise used when the difference amount calculating means 10F calculates a difference amount.

The difference amount calculating means 10F receives the detected image DW and reference image RW including the detected positioning marks $M_{D1}$ and $M_{D2}$, and reference positioning marks $M_{R1}$ and $M_{R2}$ having positions of centers of gravity and deflection angles which can be represented by the above-described expressions ① to ④, and calculates a difference amount from the difference between them.

For example, an amount of difference $\Delta\theta$ in angle, of the detected positioning marks $M_{D1}$ and $M_{D2}$ with respect to the reference positioning marks $M_{R1}$ and $M_{R2}$ is represented as below based on ② and ④.

$$\text{Difference amount } \Delta\theta=\theta_0-\theta_1 \quad ⑤$$

Therefore, by rotating the detected image DW by the difference amount $\Delta\theta$ represented by ⑤, the detected image DW and the reference image RW become parallel with each other, as shown in FIG. 5(B).

Accordingly, a difference amount $\Delta x$ in the X axis direction and a difference amount $\Delta y$ in the Y axis direction are represented as below.

$$\text{Difference amount } \Delta x \text{ in the } X \text{ axis direction}=x_1-x_1' \ (=x_2-x_2') \quad ⑥$$

$$\text{Difference amount } \Delta y \text{ in the } Y \text{ axis direction}=y_1-y_1' \ (=y_2-y_2') \quad ⑦$$

The robot control means 10G (FIG. 3) controls the robot 13 such that the detected image DW and the reference image RW coincide with each other based on the difference amounts represented by the equations ⑤ to ⑦, thereby positioning the work W at a predetermined position.

That is, when the robot control means 10G receives difference amounts $\Delta\theta$, $\Delta x$, and $\Delta y$ from the difference amount calculating means 10F, the robot control means 10G converts these into correction drive signals $S_a$, $S_b$, $S_c$, $S_d$, and $S_e$, and sends each signal to the robot 13.

Thus, the robot 13 rotates the work W supported by the gripper 14 by the difference amount $\Delta\theta=\theta_0-\theta_1$ (FIG. 5(A)), and after this, moves the work W by the difference amount $\Delta x=x_1-x_1'$ $(=x_2-x_2')$ and the difference amount $\Delta y=y_1-y_1'$ $(=y_2-y_2')$ in the X axis direction and in the Y axis direction (FIG. 5(B)), by actuating respective drive units a, b, c, d, and e constituting the robot 13.

That is, a control for making the detected image DW and the reference image RW coincide with each other is performed, thereby the work W can be fixed at a predetermined position.

The bending control means 10H (FIG. 3) controls the press brake based on the order of bending, etc. determined by the information calculating means 10B, and applies bending operations by the punch P and die D on the position-fixed work W.

The input/output means 10J is provided near the upper table 20 constituting the press brake (FIG. 6) for example, and comprises a keyboard and a screen made of liquid crystal, etc. The input/output means 10J functions as interface with respect to the aforementioned superordinate NC device 9 (FIG. 3), and thereby the subordinate NC device 10 is connected to the superordinate NC device 9 by cable or by radio and the CAD information can be received therefrom.

Further, the input/output means 10J displays the information determined by the information calculating means 10B such as the order of bending and the mold layout, etc. on the screen thereof, to allow a human worker to see the display. Therefore, the determination whether positioning of the work W by the butting faces 15 and 16 is possible or not (step 103 in FIG. 8) can be done by the human worker, not automatically.

Figure 9:
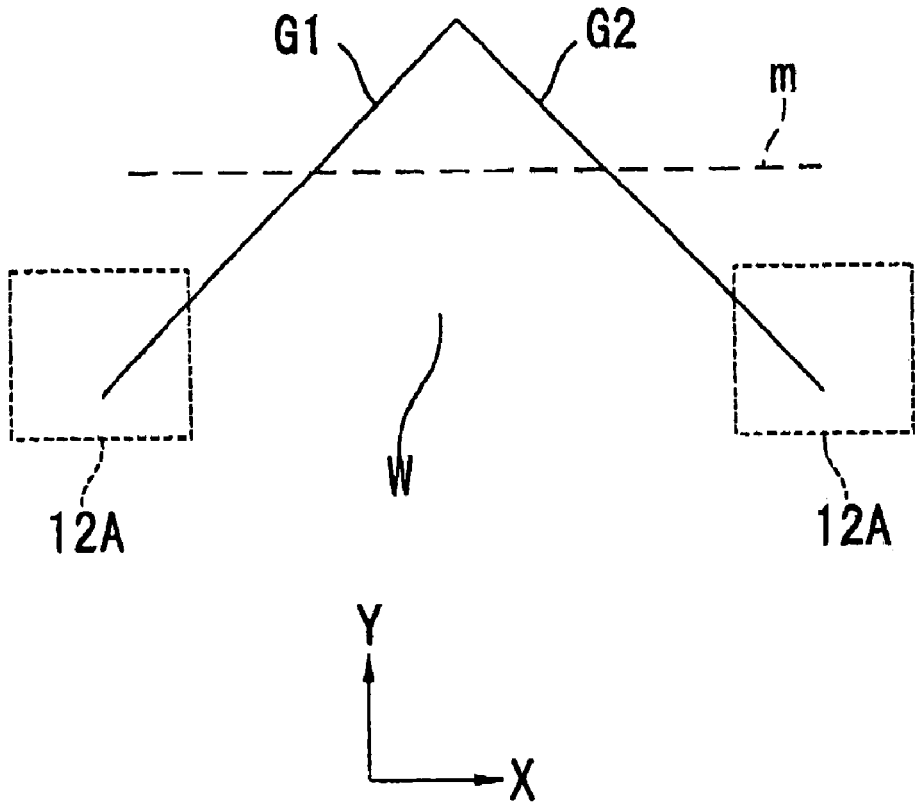
FIG. 9 is a diagram showing another example (positioning by using work outlines $G_1$ and $G_2$) of the first embodiment of the present invention.
Figure 10:
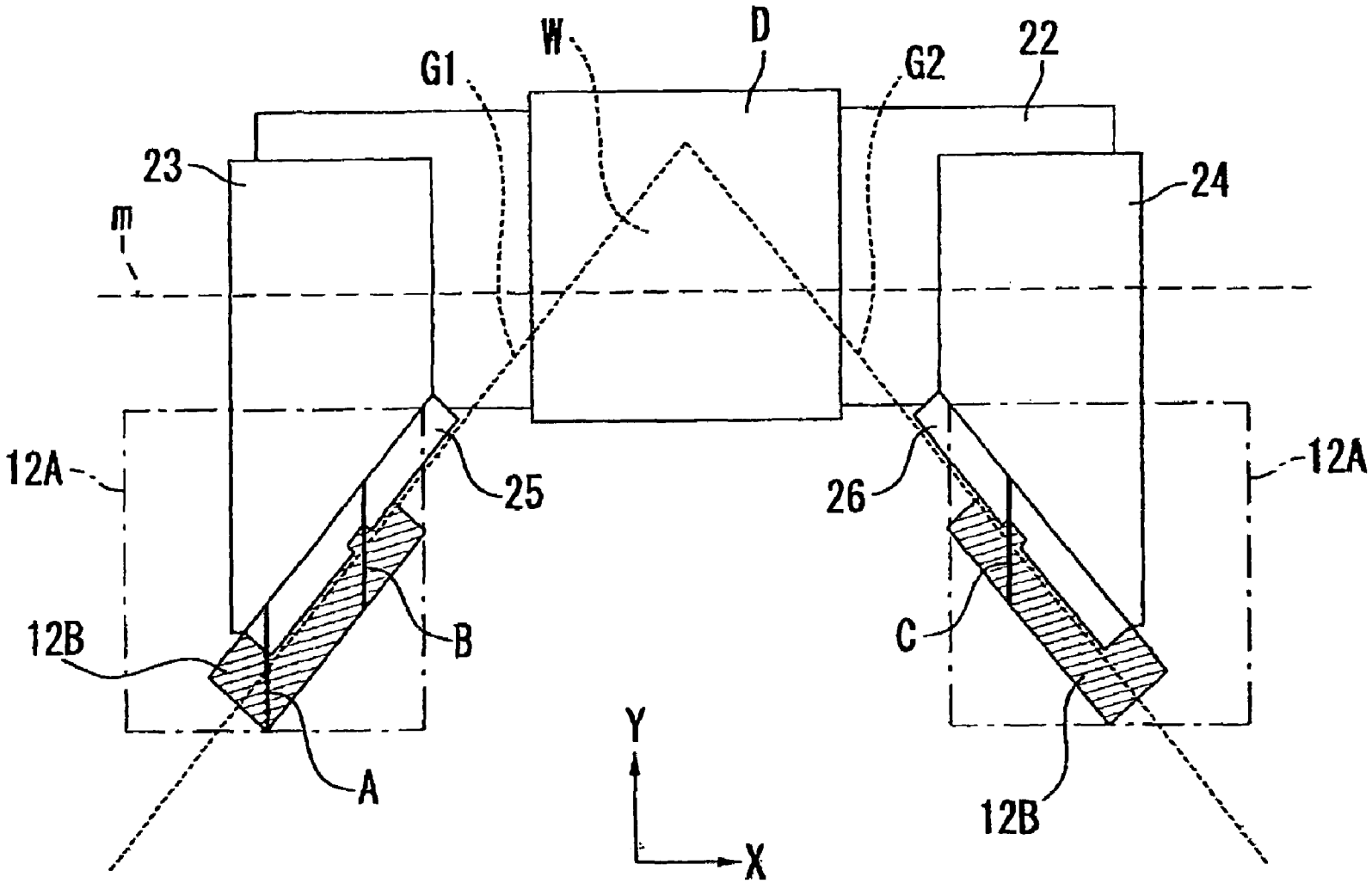
FIG. 10 is a diagram showing an example of a case where a reference image RW in FIG. 9 is photographed.
Figure 11:
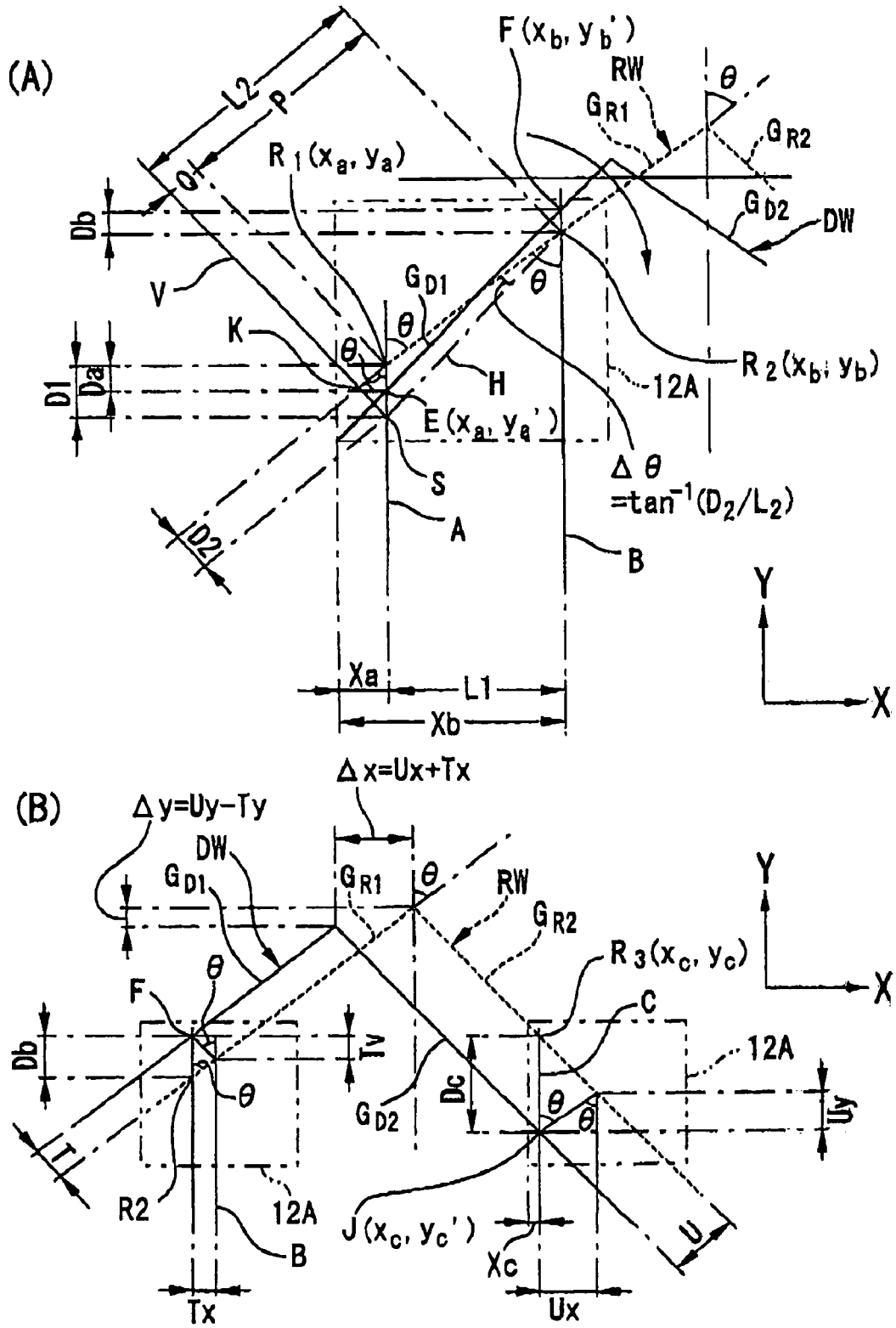
FIG. 11 are diagrams showing image processing in FIG. 9.

FIG. 9 to FIG. 11 are for the case where outlines $G_1$ and $G_2$ (FIG. 9) of the work W are used instead of the aforementioned positioning marks $M_1$ and $M_2$ (FIG. 4) as the positioning criteria. As will be described later, the difference amount calculating means 10F (FIG. 3) uses the work outlines $G_1$ and $G_2$ as the targets of comparison when a detected image DW of the work W and a reference image RW are compared with each other (FIG. 11).

Thus, the difference amount calculating means 10F calculates difference amounts $\Delta\theta$, $\Delta x$ and $\Delta y$ of detected work outlines $G_{D1}$ and $G_{D2}$ with respect to reference work outlines $G_{R1}$ and $G_{R2}$, by $\Delta\theta=\tan^{-1}(D_2/L_2)$ (FIG. 11(A)), $\Delta x=U_x+T_x$ (FIG. 11(B)), and $\Delta y=U_y-T_y$.

In this case, the reference work outlines $G_{R1}$ and $G_{R2}$ are prepared by photographing the work W which is fixed at a predetermined position by a human worker by the CCD camera 12A and storing the image in a memory.

For example, in a case where a corner of the work W (FIG. 10) is to be bent, side stoppers 25 and 26 are attached to a holder 22 of the die D via attaching members 23 and 24, and checkers A, B, and C are prepared on the side stoppers 25 and 26.

In this state, the human worker makes the work outlines $G_1$ and $G_2$ abut on the side stoppers 25 and 26, so that the work outlines $G_1$ and $G_2$ together with the checkers A, B, and C are photographed by the CCD camera 12A. Then, the image of the work outlines $G_1$ and $G_2$, and the checkers A, B, and C is converted into a one-dimensional electric signal, and further converted by the work image detecting means 10D of the subordinate NC device 10 (FIG. 3) into a two-dimensional electric signal, thereby the photographed image is stored in the memory of the work reference image calculating means 10E.

Then, the difference amount calculating means 10F uses the image of the work outlines $G_1$ and $G_2$ stored in the memory as the reference work outlines $G_{R1}$ and $G_{R2}$ (FIG. 11), and the image of the checkers A, B, and C stored in the memory as areas for detecting image data, thereby the detected image DW and the reference image RW are compared with each other.

That is, in FIG. 11, the reference image RW indicated by a broken line includes the reference work outlines $G_{R1}$ and $G_{R2}$ stored in the memory of the work reference image calculating means 10E, and the detected image DW indicated by a solid line includes the detected work outlines $G_{D1}$ and $G_{D2}$ which is obtained by photographing the work W supported by the gripper 14 of the robot 13 by the CCD camera 12A.

In this case, let it be assumed that in two-dimensional coordinates of FIG. 11(A), x-axis-direction-coordinates of the checkers A and B are $x_a$ and $x_b$, the intersection of one reference work outline $G_{R1}$ and the checker A is a first reference point $R_1(x_a, y_a)$, the intersection of the one reference work outline $G_{R1}$ and the checker B is a second reference point $R_2(x_b, y_b)$, the intersection of one detected work outline $G_{D1}$ and the checker A is $E(x_a, y_a')$, and the intersection of the one detected work outline $G_{D1}$ and the checker B is $F(x_b, y_b')$.

In FIG. 11(A), a variation $D_a$ in the Y axis direction, of the detected work outline $G_{D1}$ with respect to the first reference point $R_1(x_a, y_a)$, and a variation $D_b$ in the Y axis direction, of the detected work outline $G_{D1}$ with respect to the second reference point $R_2(x_b, y_b)$ are respectively represented as below.

$$D_a=R_1(x_a,y_a)-E(x_a,y_a')=y_a-y_a' \quad (1)$$

$$D_b=F(x_b,y_b')-R_2(x_b,y_b)=y_b'-y_b \quad (2)$$

Accordingly, if it is assumed that the intersection of a line H which is drawn parallel with the detected work outline $G_{D1}$ and the checker A is S, a distance $D_1$ between the intersection S and the first reference point $R_1(x_a, y_a)$ can be represented as below by using $D_a$ and $D_b$ in the above (1) and (2).

$$D_1=D_a-D_b \quad (3)$$

Here, if it is assumed that a deflection angle of the reference work outline $G_{R1}$ with respect to the Y axis direction is θ (FIG. 11(A)), a distance D between an intersection K of the reference work outline G and its perpendicular line V, and the intersection S can be represented as below by using the deflection angle θ and D in the above (3), as obvious from FIG. 11(A).

$$D_2=D_1\times\sin\theta \quad (4)$$

Further, if it is assumed that a distance between the checkers A and B in the X axis direction is $L_1=x_b-x_a$, a distance P between the first reference point $R_1(x_a, y_a)$ and the second reference point $R_2(x_b, y_b)$ can be represented as below by using $L_1$ and the deflection angle θ, and a distance Q between the first reference point $R_1(x_a, y_a)$ and the intersection K can be represented as below by using $D_1$ in the above (3) and likewise the deflection angle θ.

$$P=L_1/\sin\theta \quad (5)$$

$$Q=D_1\times\cos\theta \quad (6)$$

Accordingly, a distance $L_2$ between the second reference point $R_2(x_b, y_b)$ and the intersection K can be represented as below, because as obvious from FIG. 11(A), $L_2$ is the sum of P and Q which can be represented by the above (5) and (6).

$$L_2=P+Q=L_1/\sin\theta+D_1\times\cos\theta \quad (7)$$

Accordingly, an amount of difference Δθin angle, of the detected work outline $G_{D1}$ with respect to the reference work outline $G_{R1}$ is represented as below.

$$\Delta\theta=\tan^{-1}(D_2/L_2) \quad (8)$$

In the above (8), $D_2$ and $L_2$ can be represented by (4) and (7) respectively. Therefore, the difference amount Δθ can be represented by $D_1$, $L_1$, and θ by inputting (4) and (7) in (8).

$$\Delta\theta=\tan^{-1}(D_2/L_2)=\tan^{-1}\{D_1\times\sin\theta/(L_1/\sin\theta+D_1\times\cos\theta)\} \quad (9)$$

If it is assumed that the deflection angle θ of the reference work outline $G_{R1}$ with respect to the Y axis direction is 45°, the above (9) becomes $\tan^{-1}\{D_1/(2\times L_1+D_1)\}$, and thus can be represented more simply.

If the detected image DW is rotated about the intersection $F(x_b, y_b')$ between the detected image DW and the checker B by the difference amount Δθ represented by (9), the detected image DW and the reference image RW becomes parallel with each other as shown in FIG. 11(B).

In this case, in the two-dimensional coordinates of FIG. 11(B), the second reference point $R_2(x_b, y_b)$ which is the intersection between one reference work outline $G_{R1}$ and the checker B, and the intersection $F(x_b, y_b')$ between one detected work outline $G_{D1}$ and the checker B are the same as those in the case of FIG. 11(A).

Accordingly, a distance T between the detected work outline $G_{D1}$ and the reference work outline $G_{R1}$ which are parallel with each other can be represented as below by using the variation $D_b$ and the deflection angle θ.

$$T=D_b\times\sin\theta \quad (10)$$

The X-axis-direction component $T_x$ and Y-axis-direction component $T_y$ of T are obtained as below.

$$T_x=T\times\cos\theta=D_b\times\sin\theta\times\cos\theta \quad (11)$$

$$T_y=T\times\sin\theta=D_b\times\sin^2\theta \quad (12)$$

In the two-dimensional coordinates of FIG. 11(B), it is assumed that the x-axis-direction coordinate of the checker C is $x_c$, the intersection between the other reference work outline $G_{R2}$ and the checker C is a third reference point $R_3(x_c, y_c)$, and the intersection between the other detected work outline $G_{D2}$ and the checker C is $J(x_c, y_c')$.

In this case, in FIG. 11 (B), a variation $D_c$ in the Y axis direction, of the other detected work outline $G_{D2}$ with respect to the third reference point $R_3(x_c, y_c)$ is represented as below.

$$D_c=R_3(x_c,y_c)-J(x_c,y_c')=y_c-y_c' \quad (13)$$

Accordingly, a distance U between the detected work outline $G_{D2}$ and the reference work outline $G_{R2}$ which are parallel with each other can be represented as below by using the variation $D_c$ which can be represented by the above (13) and the deflection angle θ.

$$U=D_c\times\cos\theta \tag{14}$$

The X-axis-direction component $U_x$ and Y-axis-direction component $U_y$ of U are obtained as below.

$$U_x=U\times\sin\theta=D_c\times\sin\theta\times\cos\theta \tag{15}$$

$$U_y=U\times\cos\theta=D_c\times\mathrm{con}^2\theta \tag{16}$$

Accordingly, a difference amount in the X axis direction and a difference amount Δy in the Y axis direction can be represented as below by using $U_x$ and $U_y$ which can be represented by (15) and (16) and $T_x$ and $T_y$ which can be represented by the above (11) and (12).

$$\begin{aligned}\text{Difference amount } \Delta x \text{ in the } X \text{ axis direction} &= U_x + T_x \\ &= (D_c + D_b)\times\sin\theta\times\cos\theta\end{aligned} \tag{17}$$

$$\begin{aligned}\text{Difference amount } \Delta y \text{ in the } Y \text{ axis direction} &= U_y - T_y \\ &= D_b\times\sin^2\theta - D_c\times con^2\theta\end{aligned} \tag{18}$$

Therefore, in a case where the work outlines G and G in FIG. 9 to FIG. 11 are used as the positioning criteria, the robot control means 10G (FIG. 3) controls the robot 13 such that the detected image DW and the reference image RW coincide with each other based on the difference amounts which can be represented by (9), (17) and (18), thereby fixing the work W at a predetermined position.

Figure 12:
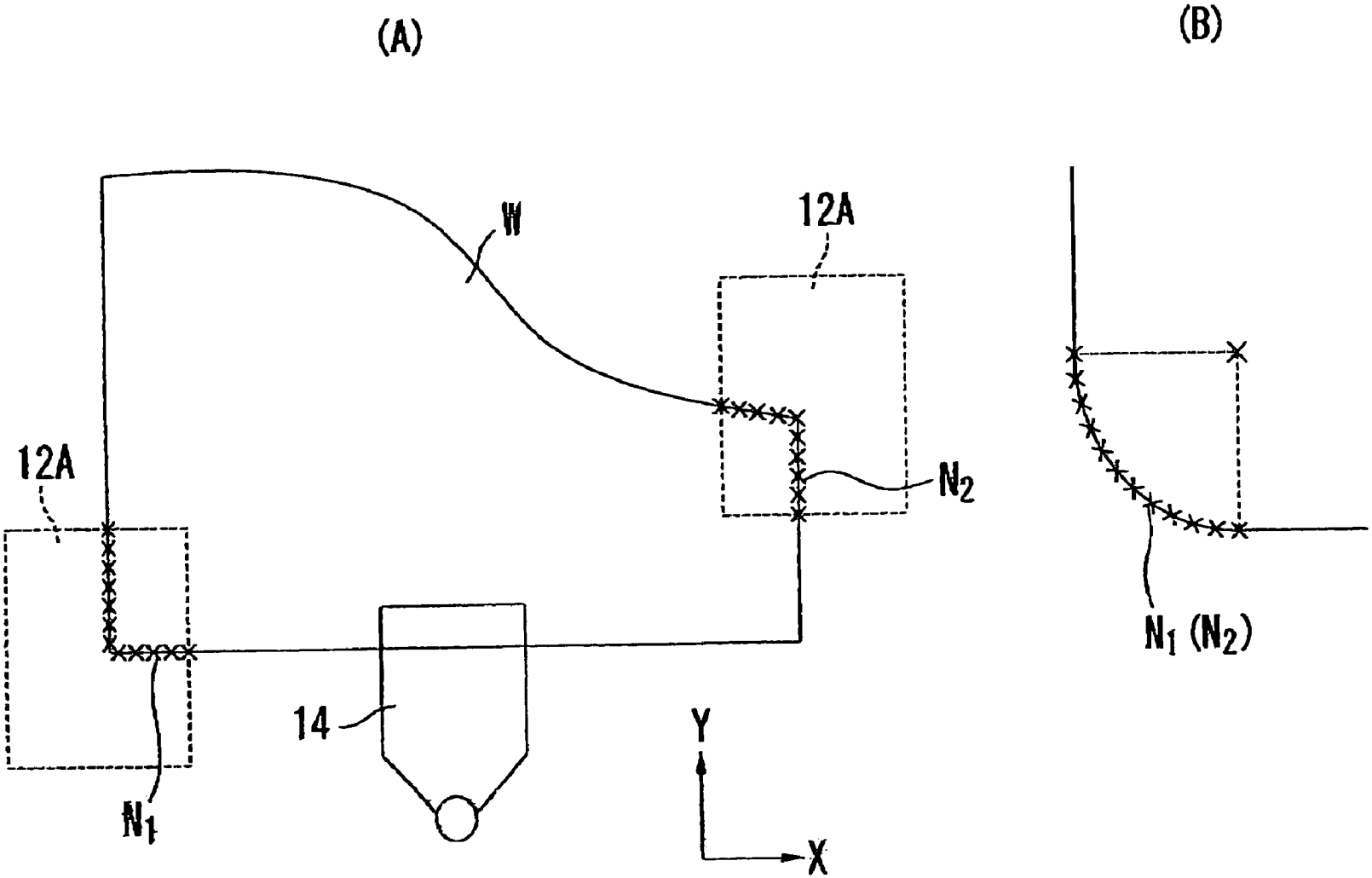
FIG. 12 are diagrams showing an example of a case where a detected image DW and a reference image RW are compared by using corners $N_1$ and $N_2$ in the first embodiment of the present invention.
Figure 13:
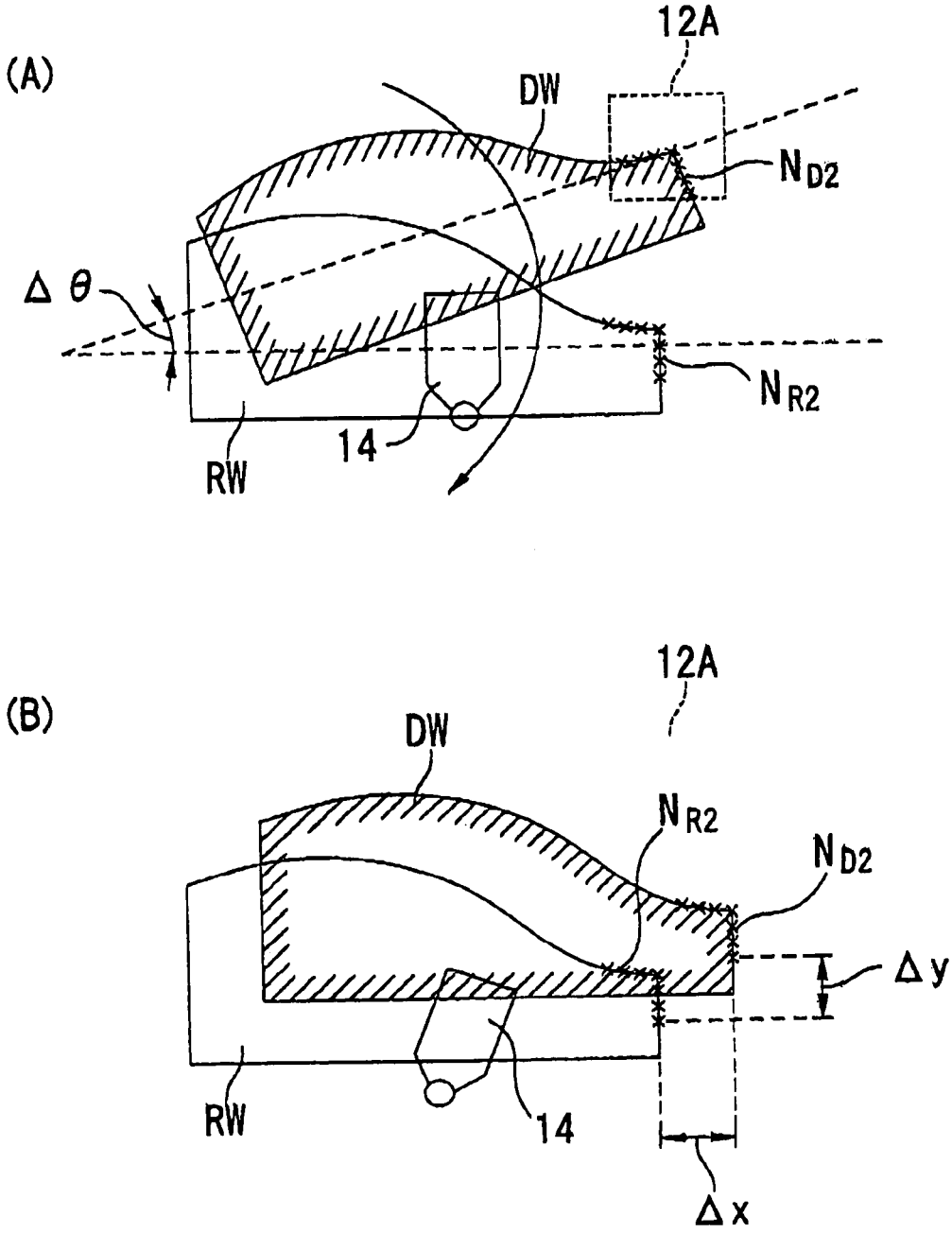
FIG. 13 are diagrams showing image processing in FIG. 12.

FIG. 12 to FIG. 14 are for the case where either a corner $N_1$ or a corner $N_2$ (FIG. 12) of a work W is used as a positioning criterion instead of the above-described positioning marks $M_1$ and $M_2$ (FIG. 4) and outlines $G_1$ and $G_2$ of a work W (FIG. 9). The difference amount calculating means 10F (FIG. 3) uses either the corner $N_1$ or the corner $N_2$ as the target of comparison when a detected image DW of the work W and a reference image RW are compared with each other (FIG. 13).

With this structure, if one work photographing means 12 (FIG. 3), i.e. one CCD camera 12A photographs only either the corner $N_1$ or $N_2$, the difference amount calculating means 10F (FIG. 3) can calculate difference amounts Δθ (FIG. 13(A)), Δx (FIG. 13(B)), and Δy of an entire detected corner $N_{D2}$ with respect to an entire reference corner $N_{R2}$.

Accordingly, the robot control means 30G (FIG. 3) can position the work W at a predetermined position by controlling the robot 13 such that the detected image DW and the reference image RW coincide with each other at one time, based on the difference amounts Δθ, Δx, and Δy.

Figure 5:
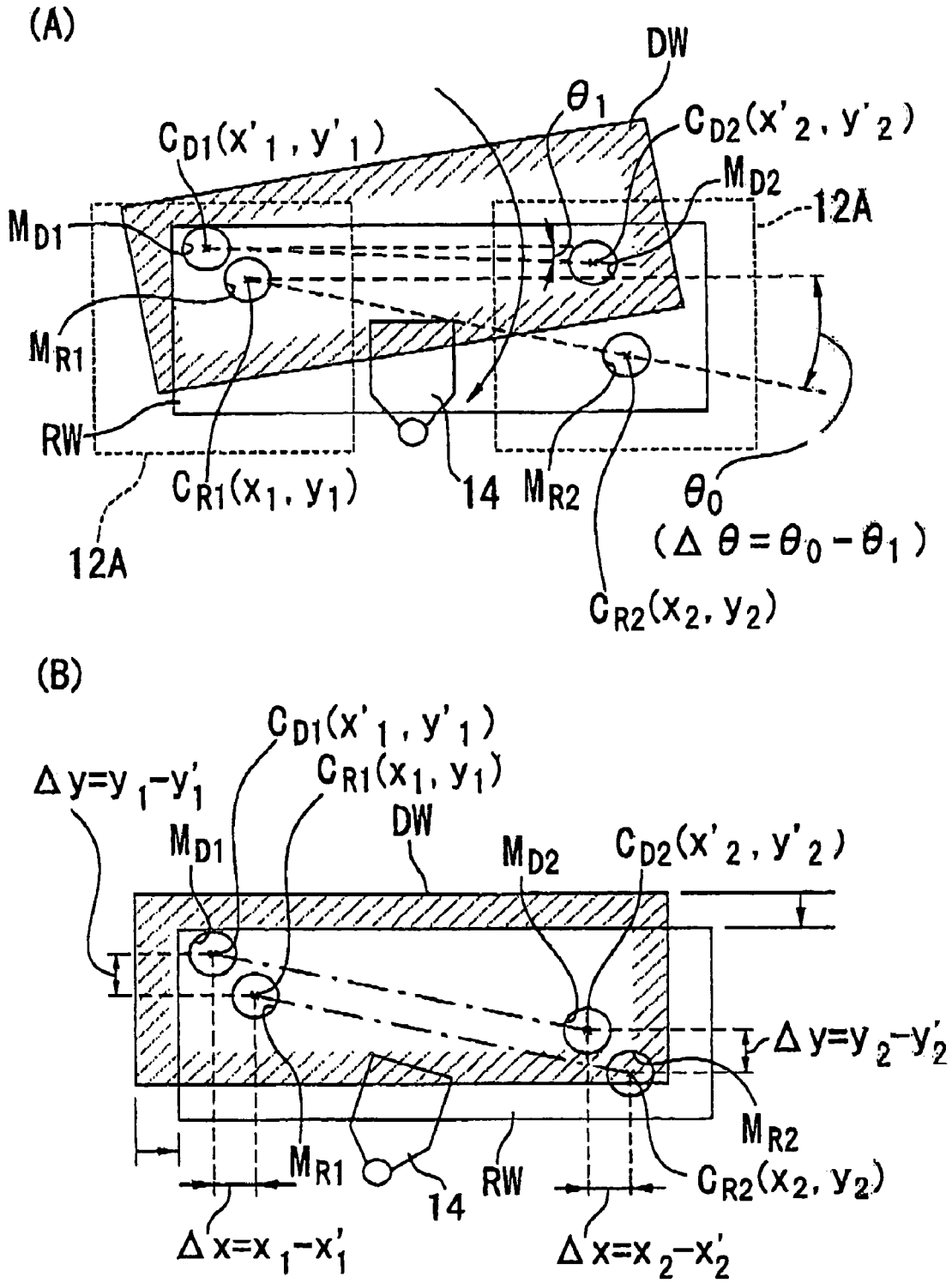
FIG. 5 are diagrams showing image processing according to the first embodiment of the present invention.

That is, in case of the positioning marks $M_1$ and $M_2$ (FIG. 4), or the outlines $G_1$ and $G_2$ (FIG. 9) of the work W, positioning of the work W can not be carried out unless the positions of the two positioning marks $M_1$ and $M_2$ or the positions of the two work outlines $G_1$ and $G_2$ are determined with the use of two CCD cameras 12A, in order to compare the detected image DW and the reference image RW (FIG. 5, FIG. 11).

However, for such a positioning operation of a work W by image processing as the present invention, the case that the corner $N_1$ or $N_2$ is used as the target of comparison when the detected image DW and the reference image RW are compared is very frequent, accounting for nearly 80% of all.

Therefore, as will be described later, if the position of either the corner $N_1$ or $N_2$ is determined by using only one CCD camera 12A, comparison of the detected image DW and the reference image RW becomes available, and positioning of the work W by image processing can be carried out with only one time of difference amount correction. Accordingly, the efficiency of the entire operation including the positioning of the work W will be greatly improved.

The outline of the work W shown in FIG. 12(A) can be first raised as an example where, as described above, an entire view of either the corner $N_1$ or $N_2$ is photographed to be used as the target of comparison between the detected image DW and the reference image RW.

In this case, the angle of the corner $N_1$ or $N_2$ may be anything, such as an acute angle, an obtuse angle, and a right angle, or may be R (FIG. 12(B)).

However, difference amounts, in particular, the difference amount Δθ in the angular direction (FIG. 13) can not be corrected unless the corner $N_1$ or $N_2$ is not partly, but entirely photographed by the CCD camera 12A.

An example of a case where the detected image DW and the reference image RW are compared with the use of such corners $N_1$ and $N_2$, will now be explained based on FIG. 13.

In FIG. 13(A), if an image of the entire corner $N_2$ which is photographed by, for example, the CCD camera 12A on the right side is input to the work image detecting means 10D (FIG. 3), a detected corner $N_{D2}$ as a part of the detected image DW can be obtained.

Accordingly, if this detected corner $N_{D2}$ is input to the difference amount calculating means 10F together with a reference corner $N_{R2}$ which is pre-calculated by the work reference image calculating means 10E (FIG. 3), an amount of difference Δθ in the angular direction between the entire detected corner $N_{D2}$ and the entire reference corner $N_{R2}$ is calculated.

Then, the detected corner $N_{D2}$ is rotated by the calculated amount of difference Δθ in the angular direction, such that the detected image DW (FIG. 13(B)) including the detected corner $N_{D2}$ and the reference image RW including the reference corner $N_{R2}$ become parallel with each other.

Due to this, the difference amount calculating means 10F (FIG. 3) can calculate amounts of difference Δx and Δy in the Y axis direction between the entire detected corner $N_{D2}$ (FIG. 13(B)) and the entire reference corner $N_{R2}$.

Accordingly, by rotating, via the robot control means 30G (FIG. 3), the work W supported by the gripper 14 (FIG. 13) of the robot 13 by the amount of difference Δθ, and moving the work W by the amounts of difference Δx and Δy in the W axis direction and in the Y axis direction, a control for making the detected image DW and the reference image RW coincide with each other is performed, thereby the work W can be positioned at a predetermined position.

Square holes $M_1$ and $M_2$ shown in FIG. 14 are an example of using either the corner $N_1$ or $N_2$ as the target of comparison between the detected image DW and the reference image RW.

For example, in a case where the square holes $M_1$ and $M_2$ are formed as positioning marks at predetermined positions y1 and y2 apart from a bending line m (FIG. 14), the entire view of either the corner $N_1$ or $N_2$ is photographed by the CCD camera 12A.

Then, for example, the image of the entire corner $N_2$ which is photographed by the CCD camera 12A on the right side of FIG. 14 is used as a detected corner $N_{D2}$ (corresponding to FIG. 13), so as to be compared with a pre-calculated reference corner $N_{R2}$.

Due to this, a difference amount Δθ in the angular direction, a difference amount Δx in the X axis direction, and a difference amount Δy in the Y axis direction are likewise calculated by the difference amount calculating means 10F (FIG. 3). Based on these difference amounts, the robot control means 30G performs a control for making the detected image DW and the reference image RW coincide with each other, thereby the work W can be positioned at a predetermined position.

An operation according to a first embodiment of the present invention having the above-described structure will now be explained based on FIG. 8.

(1) Determination Whether Positioning of a Work W by the Butting Faces 15 and 16 is Possible or Not.

CAD information is input in step 101 of FIG. 8, the order of bending, etc. is determined in step 102, and whether positioning of the work W by the butting faces 15 and 16 is possible or not is determined in step 103.

That is, when CAD information is input from the superordinate NC device 9 (FIG. 3) to the subordinate NC device 10, the information calculating means 100B constituting the superordinate NC device 9 determines the order of bending, etc. Based on the determined information, it is determined whether positioning of the work W by the butting faces 15 and 16 is possible, automatically (for example, determination by the information calculating means 10B in accordance with an instruction of the CPU 10A) or manually (determination by a human worker by seeing the screen of the input/output means 10J, as described before).

In a case where positioning by the butting faces 15 and 16 is possible (step 103 of FIG. 8: YES), the flow goes to step 109, so that positioning is carried out conventionally by butting the work W on the butting faces 15 and 16.

However, in a case where positioning by the butting faces 15 and 16 is impossible (step 103 of FIG. 8: NO), the flow goes to step 104 sequentially, so that positioning by using image processing according to the present invention is carried out.

(2) Positioning Operation by Using Image Processing.

A reference image RW of the work W is calculated in step 104 of FIG. 8. An image of the work W is detected in step 105. The detected image DW and the reference image RW are compared in step 106. Whether or not there is any difference between them is determined in step 107.

That is, in such a case as this where positioning by the butting faces 15 and 16 is impossible, the work reference image calculating means 10E pre-calculates the reference image RW (FIG. 5A) based on the determination by the information calculating means 10B, and stores it in a memory (not illustrated) or the like.

In this state, the CPU 10A of the subordinate NC device 10 (FIG. 3) moves the CCD camera 12A and its light source 12B both constituting the work photographing means 12 via the photographing control means 10C, in order to photograph the work W supported by the gripper 14 of the robot 13.

The photographed image of the work W is sent to the work image detecting means 10D, thereby the detected image DW is obtained and subsequently compared (FIG. 5A) with the reference image RW stored in the memory by the difference amount calculating means 10F.

Then, the difference amount calculating means 10F calculates amounts of difference (⑤ to ⑦ aforementioned) between the detected image DW and the reference image RW. When these amounts of difference are zero, i.e. when there is no difference between them (step 107 in FIG. 6: NO), the positioning is completed, and the bending operation is carried out in step 110.

However, in a case where there is difference between the detected image DW and the reference image RW (step 107 in FIG. 8: YES), positioning of the work W by the robot 13 is performed in step 108.

That is, in a case where there is difference between the detected image DW and the reference image RW (FIG. 5(A)), the difference amount calculating means 10F sends the calculated difference amounts (⑤ to ⑦) to the robot control means 10G.

Then, the robot control means 10G converts the difference amounts (⑤ to ⑦) into correction drive signals $S_a$, $S_b$, $S_c$, $S_d$, and $S_e$ and sends these signals to the robot 13, so that the drive units a, b, c, d, and e of the robot 13 will be controlled such that the detected image DW and the reference image RW coincide with each other (FIG. 5(B)) and the work W is positioned at a predetermined position.

In a case where positioning of the work W by the robot 13 is carried out in this manner, the flow returns to step 105 of FIG. 8 after this positioning, in order to again photograph the image of the positioned work W by the CCD camera 12A for confirmation. After photographing, the photographed image is detected by the work image detecting means 10D, and compared with the reference image RW in step 106. Then, in a case where it is determined in step 107 that there is no difference between them (NO), positioning is finally completed and the flow goes to step 110.

(3) Bending Operation.

In a case where the difference amount calculating means 10F which receives the detected image DW (FIG. 3) and the reference image RW determines that there is no difference between them, this message is transmitted from the difference amount calculating means 10F to the CPU 10A. The CPU 10A actuates a ram cylinder (not illustrated), etc. via the bending control means 10H, so that the bending operation is carried out on the work W supported by the gripper 14 of the robot 13 by the punch P and die D.

In a case where positioning is carried out by butting the work W on the butting faces 15 and 16 as conventionally (step 109 in FIG. 8), a positioning completion signal is sent from a sensor (not illustrated) attached to the butting faces 15 and 16 to the CPU 10A. Based on this signal, the ram cylinder is actuated via the bending control means 10H likewise the above, and the work W supported by the gripper 14 of the robot 13 is subjected to the bending operation by the punch P and die E.

(4) Positioning Operation in Case of Using the Work Outlines $G_1$ and $G_2$.

That is, also in case of the positioning operation by using the work outlines $G_1$ and $G_2$ shown in FIG. 9 to FIG. 11 as the positioning criteria, the procedures shown in FIG. 8 are followed in exactly the same manner as the case of using the positioning marks $M_1$ and $M_2$ (FIG. 4).

However, the difference between the cases is that as for the positioning marks $M_1$ and $M_2$ (FIG. 4), image data constituting the reference positioning marks $M_{R1}$ and $M_{R2}$ (FIG. 5) is included in the CAD information stored in the superordinate NC device 9 (FIG. 3) as described above, while as for the work outlines $G_1$ and $G_2$ (FIG. 9), image data constituting the reference work outlines $G_{R1}$ and $G_{R2}$ (FIG. 11) is not included in the CAD information, but obtained by a human worker positioning the work W at a predetermined position (for example, FIG. 10) to photograph the work outlines $G_1$ and $G_2$ by the CCD camera 12A.

However, the reference work outlines $G_{R1}$ and $G_{R2}$ may be included in the CAD information likewise the reference positioning marks $M_{R1}$ and $M_{R2}$.

(5) Positioning Operation in Case of Using the Corners $N_1$ and $N_2$ of a Work W.

That is, also in case of the positioning operation by using the corners $N_1$ and $N_2$ shown in FIG. 12 to FIG. 14 as the positioning criteria, the procedures shown in FIG. 8 are followed in exactly the same manner as the case of using the positioning marks $M_1$ and $M_2$ (FIG. 4) or the work outlines $G_1$ and $G_2$ (FIG. 9).

However, as described above, unlike the positioning marks $M_1$ and $M_2$ (FIG. 4), etc., comparison between the detected image DW and the reference image RW by image processing (FIG. 13) is available, only by photographing the image of either the corner $N_1$ (FIG. 12) or $N_2$ by one CCD camera 12A. Then, the work W can be positioned at a predetermined position by correcting the difference amounts $\Delta\theta$, $\Delta x$, and $\Delta y$ at one time. Accordingly, the efficiency of the entire operation is improved.

Figure 15:
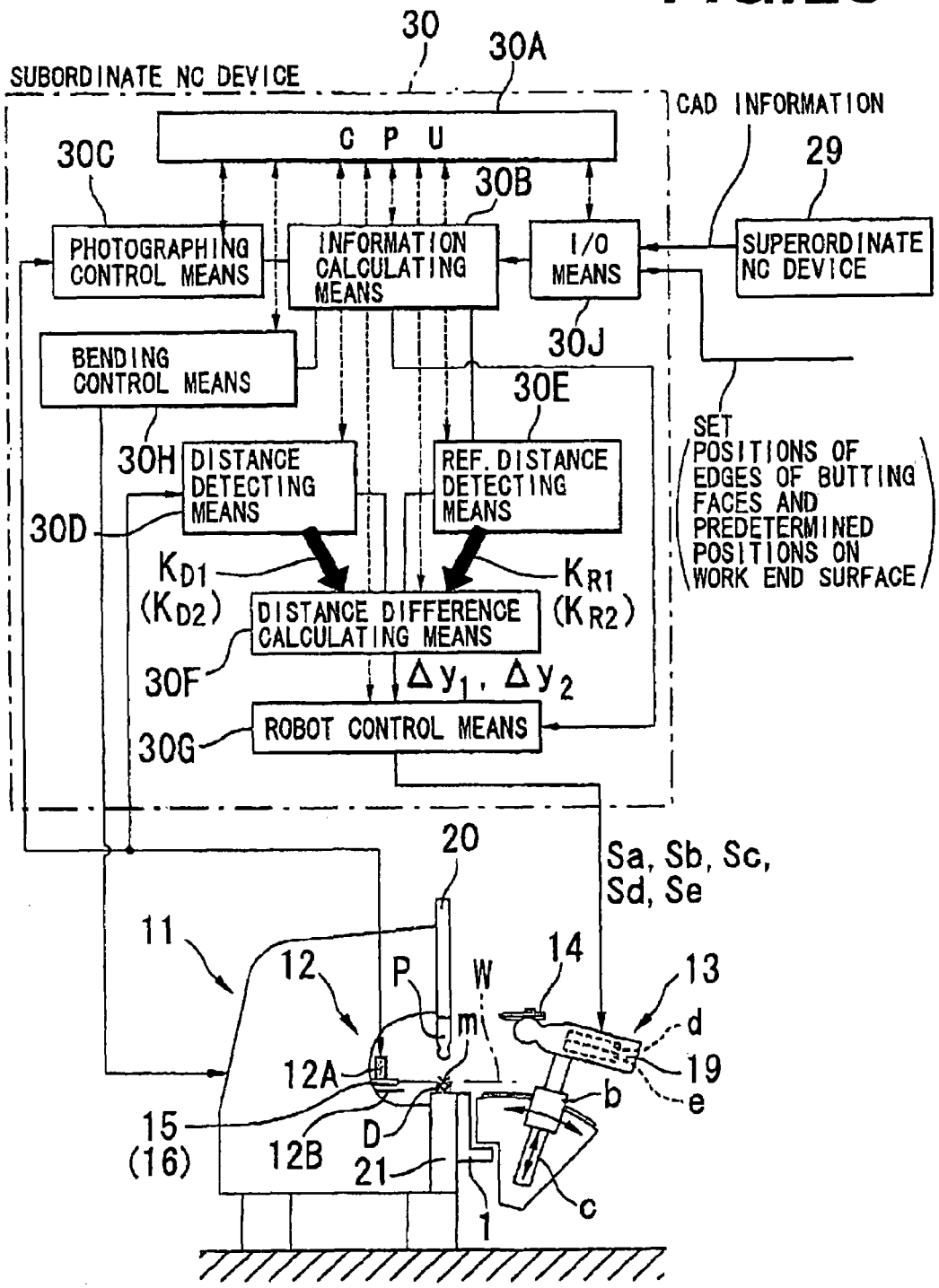
FIG. 15 is an entire view showing a second embodiment of the present invention.

FIG. 15 is an entire view showing a second embodiment of the present invention.

In FIG. 15, a reference numeral 29 denotes a superordinate NC device, 30 denotes a subordinate NC device, 11 denotes a bending machine, 12 denotes a work photographing means, and 13 denotes a robot.

Figure 23:
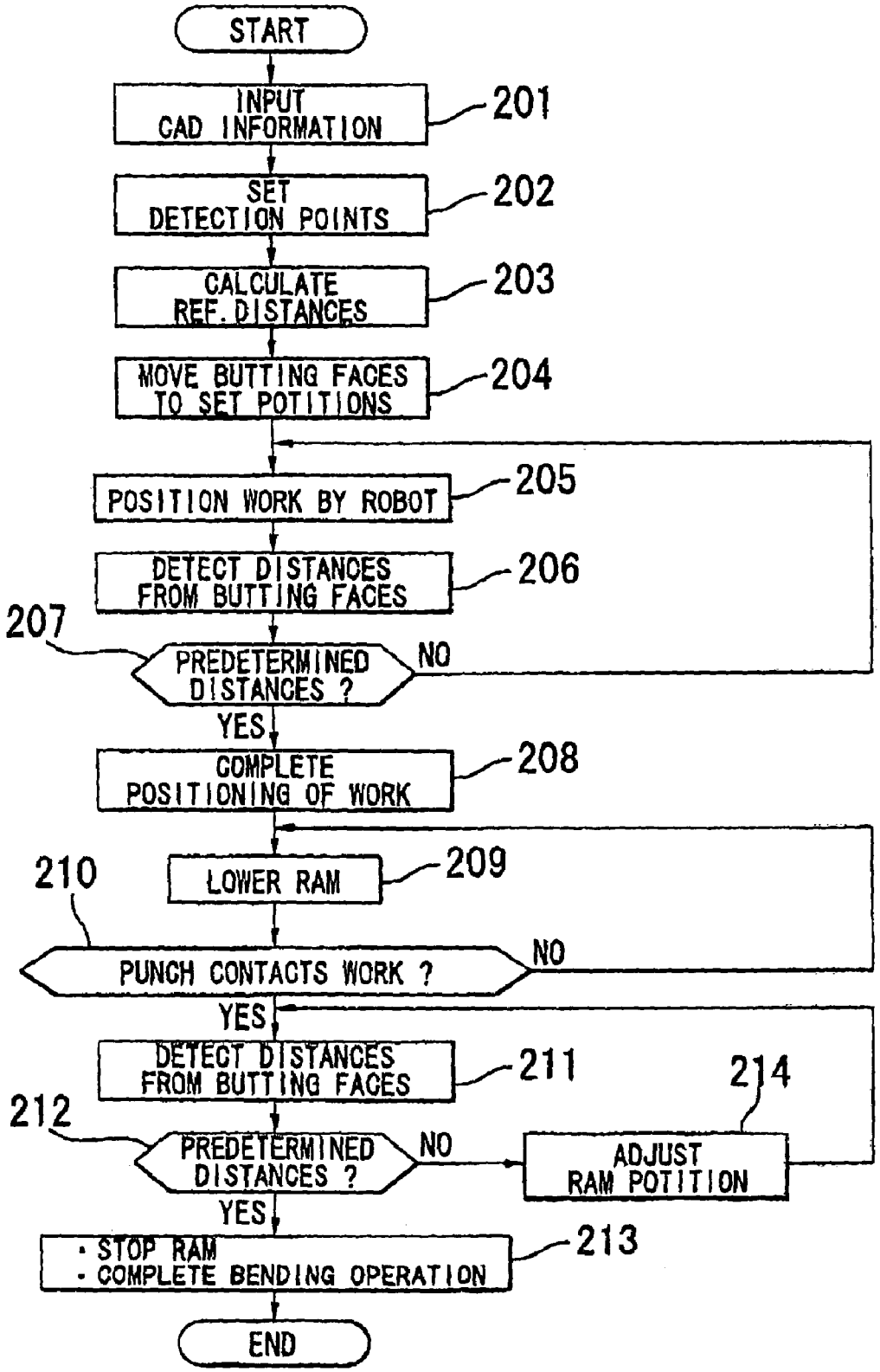
FIG. 23 is a flowchart for explaining an operation according to the second embodiment of the present invention.

With this structure, for example, CAD information is input from the superordinate NC device 29 to the subordinate NC device 30 which is a control device of the bending machine 11 (step 201 in FIG. 23), and setting of the positions $B_{R1}$ and $B_{R2}$ of the edges of butting faces 15 (FIG. 18) and 16 and predetermined positions $A_{R1}$ and $A_{R2}$ on the end surface $T_R$ of a work image RW is carried out (steps 202 to 204 in FIG. 23). After this, positioning of a work W by predetermined image processing is carried out by the subordinate NC device 30 (steps 205 to 208 in FIG. 23). After the punch P (FIG. 19 (B)) contacts the work W (after pinching point), a bending angle $\Theta$ is indirectly measured by detecting a distance $k_1$ between the work W and the butting face 15, and then the bending operation is carried out (steps 209 to 213 in FIG. 23).

Due to this, positioning of the work W and measuring of the bending angle $\Theta$ can be carried out by one device, making it possible to simplify the system.

In this case, the bending machine 11 (FIG. 15) and the robot 13 are the same as the first embodiment (FIG. 3). However, the positions at which the CCD camera 12A and its light source 12B constituting the work photographing means 12 are attached, and their moving mechanism are different from the first embodiment.

That is, as described above, the butting faces 15 and 16 are provided behind the lower table 21 which constitutes the press brake.

Figure 21:
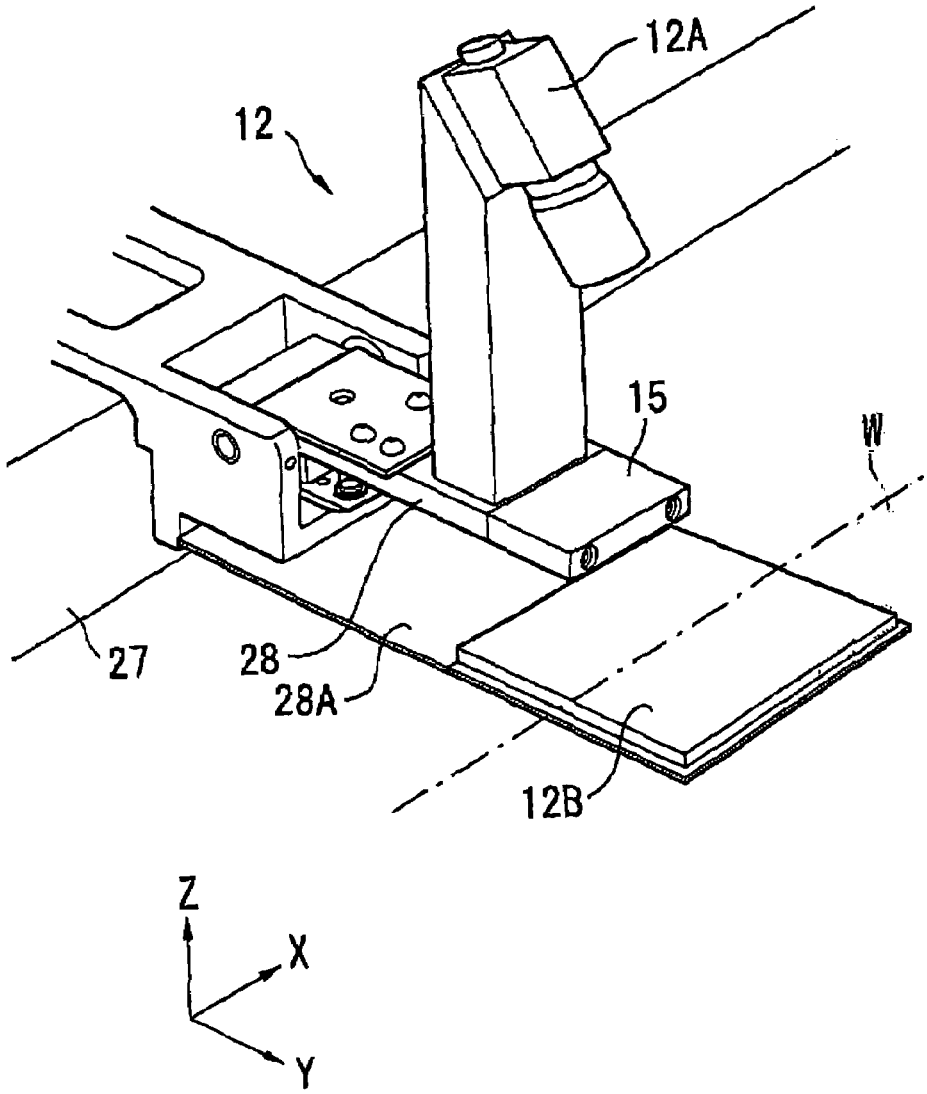
FIG. 21 is a diagram showing work photographing means 12 used in the second embodiment of the present invention.

As shown in FIG. 21, for example, the butting face 15 is attached to a stretch 27 via a butting face body 28. According to the second embodiment, the CCD camera 12A is attached to this butting face body 28.

Further, an attaching plate 28A is provided to the butting face body 28, and the light source 12B for supplying a permeation light to the work W is attached to the attaching plate 28A.

Due to this, as the butting face 15 moves in the X axis direction, Y axis direction, or Z axis direction, the CCD camera 12A and the light source 12B move in the same direction. Therefore, there is no need of providing a special moving mechanism for the CCD camera 12A and its light source 12B unlike the first embodiment (FIG. 3), thereby enabling cost cut.

Further, with this structure, the work W supported by the gripper 14 of the robot 13 (FIG. 15) is photographed by the CCD camera 12A, and the image of the work W is converted into a one-dimensional electric signal, and then converted into a two-dimensional electric signal by later-described distance detecting means 30D of the subordinate NC device 30 (FIG. 15). Thereby, the distances $K_{D1}$ and $K_{D2}$ between the positions $B_{R1}$ and $B_{R2}$ (FIG. 18) of the edges of the butting faces 15 and 16 and predetermined positions $A_{D1}$ and $A_{D2}$ on an end surface $T_D$ of the work image DW are detected, and differences in distance $\Delta y_1$ and $\Delta y_2$ between the detected distances $K_{D1}$ and $K_{D2}$ and reference distances $K_{R1}$ and $K_{R2}$ are calculated (FIG. 18) by a distance difference calculating means 30F (FIG. 15).

Figure 16:
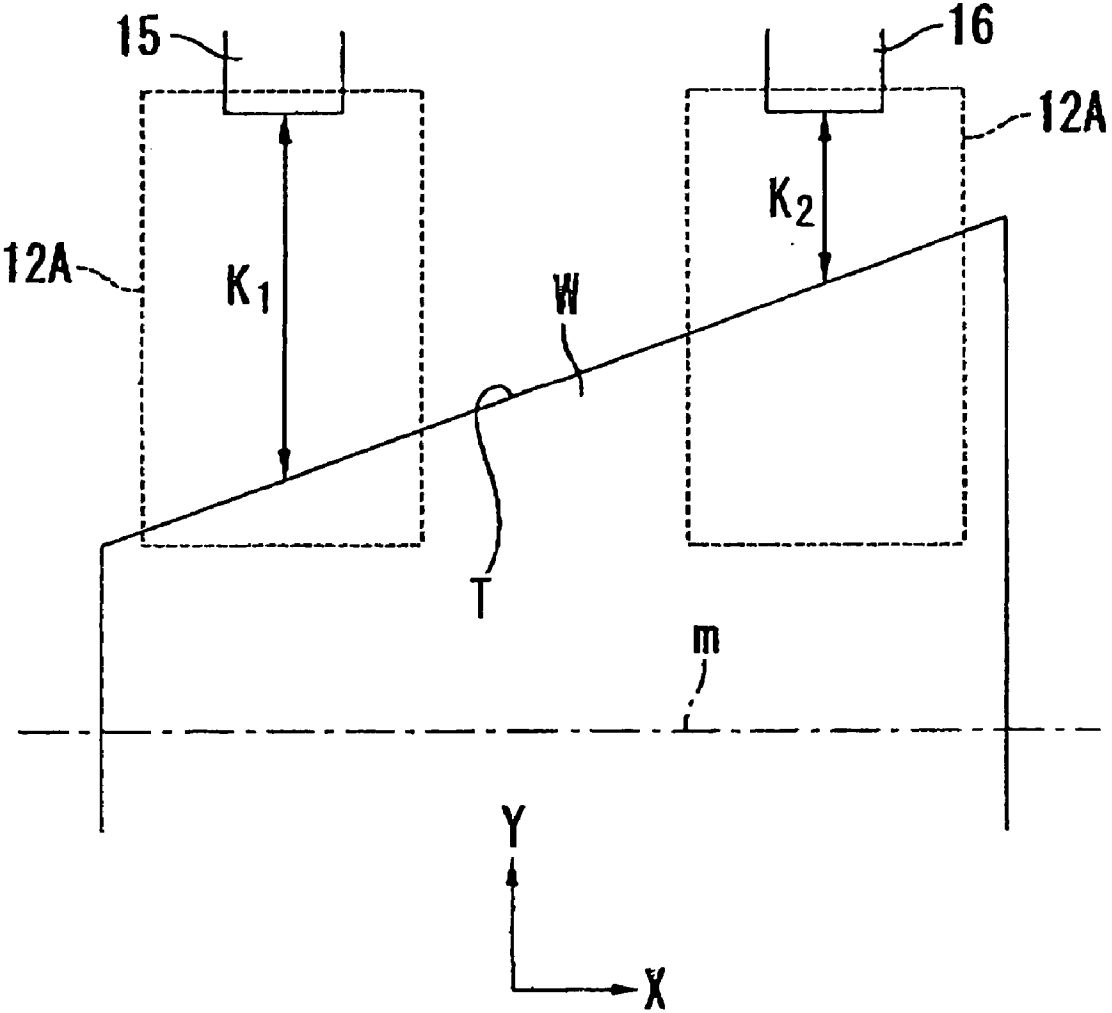
FIG. 16 is a diagram showing positioning criteria K and K according to the second embodiment of the present invention.

In the second embodiment, distances $K_1$ and $K_2$ between the positions of the edges of the butting faces 15 and 16 and predetermined positions on the work end surface T are used as the positioning criteria as shown in FIG. 16. These positioning criteria are especially effective in positioning the work W in case of diagonal bending where the work end surface T and a bending line m are not parallel with each other.

Figure 17:
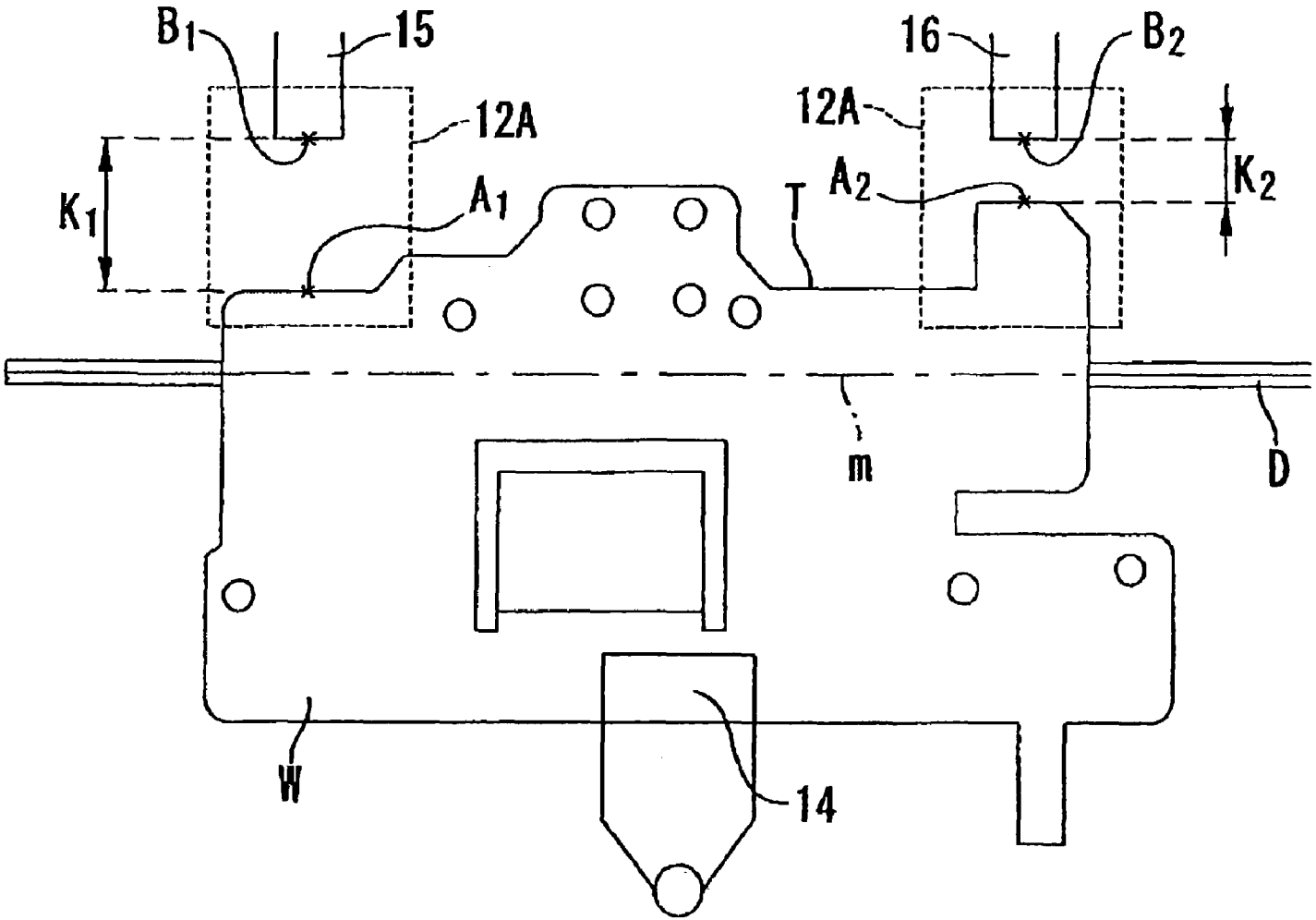
FIG. 17 is a diagram showing a specific example of FIG. 16.

In some cases, the work end surface T has a very complicated form as shown in FIG. 17. In order to accurately detect the distances $K_1$ and $K_2$ from the butting faces 15 and 16, it is necessary to set in advance the positions $B_1$ and $B_2$ of the edges of the butting faces 15 and 16, and predetermined positions $A_1$ and $A_2$ on the work end surface T as the detection points.

Figure 18:
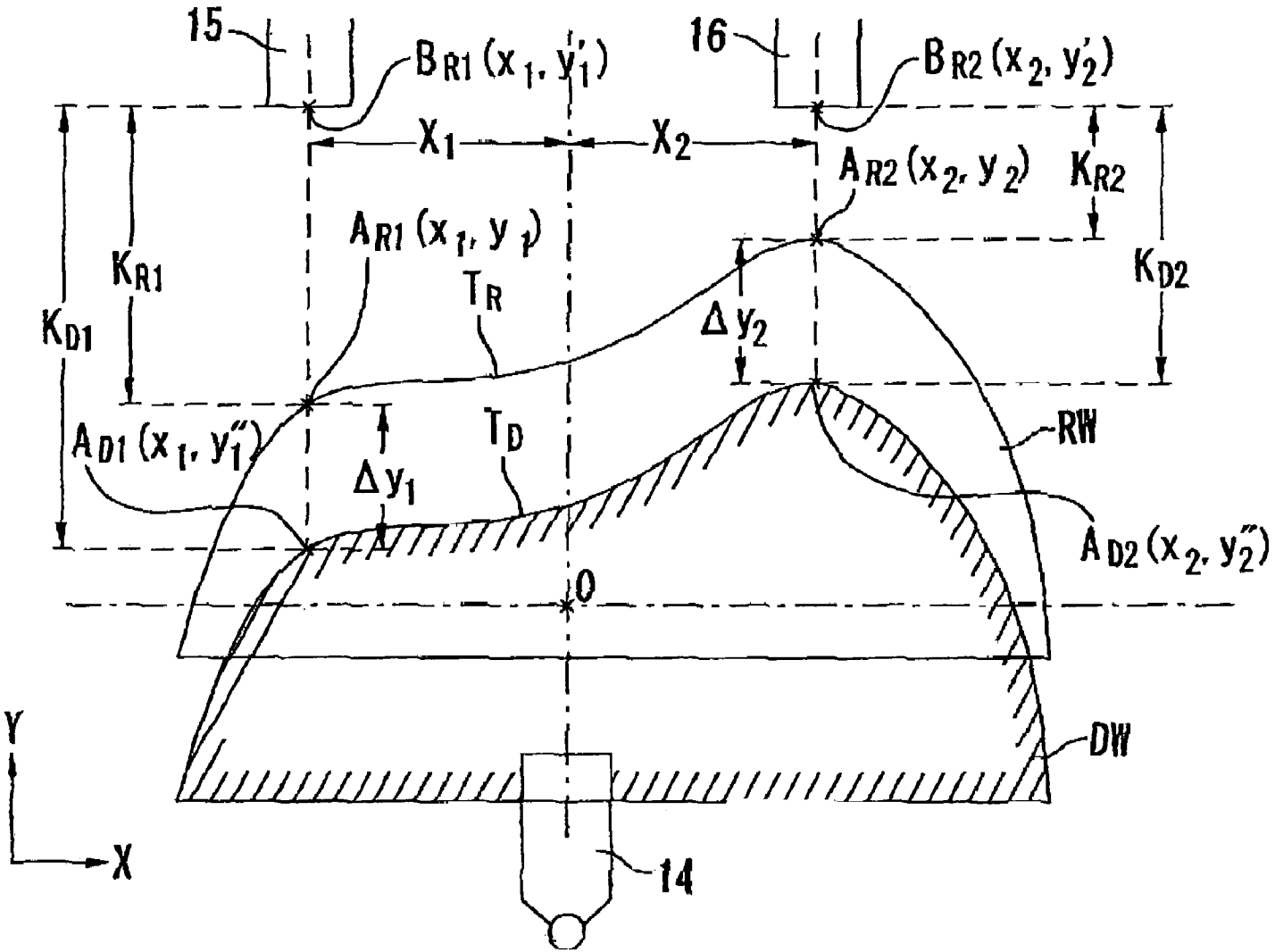
FIG. 18 is a diagram showing image processing according to the second embodiment of the present invention, FIG. 19 are diagrams for explaining a post-work positioning operation according to the second embodiment of the present invention (measuring of a bending angle Θ)

Specifically, for example, with the input of CAD information (step 201 in FIG. 23), the work image RW as a development is obtained as shown in FIG. 18, and is displayed on the screen.

Figure 24:
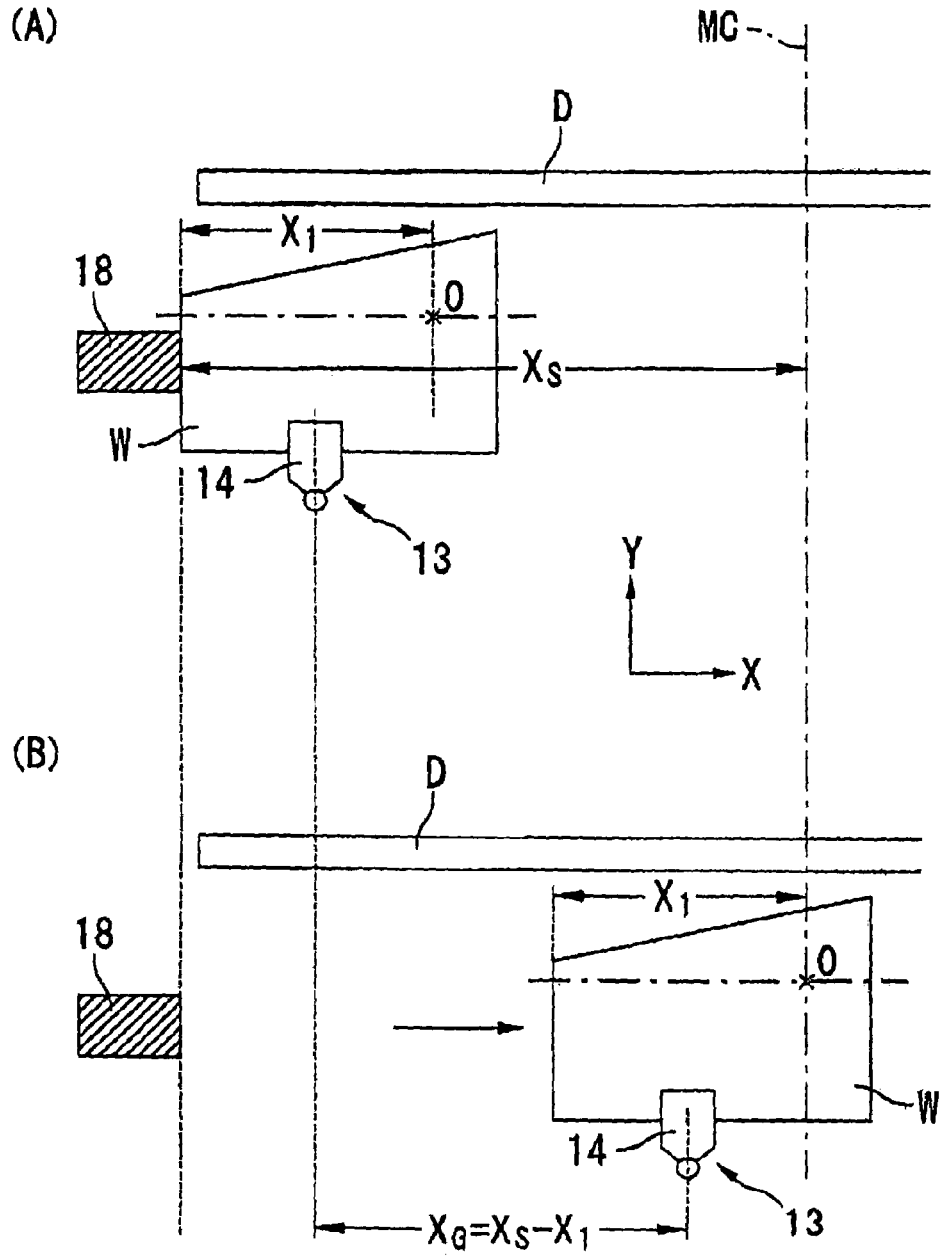
FIG. 24 are diagrams showing positioning of the longitudinal direction of a work, which is carried out prior to positioning by image processing according to the second embodiment of the present invention.
Figure 25:
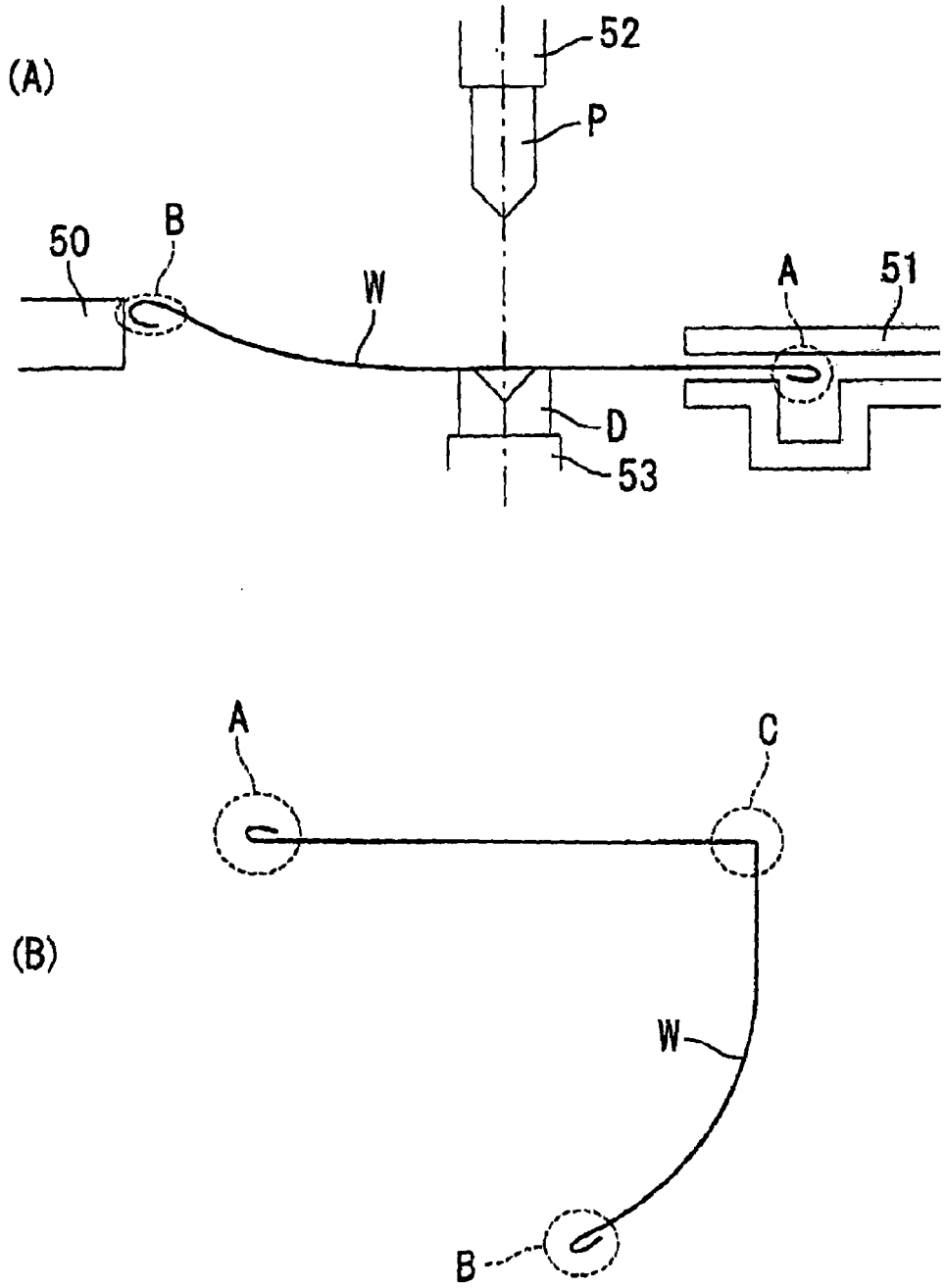
FIG. 25 are diagrams for explaining prior art.
Figure 26:
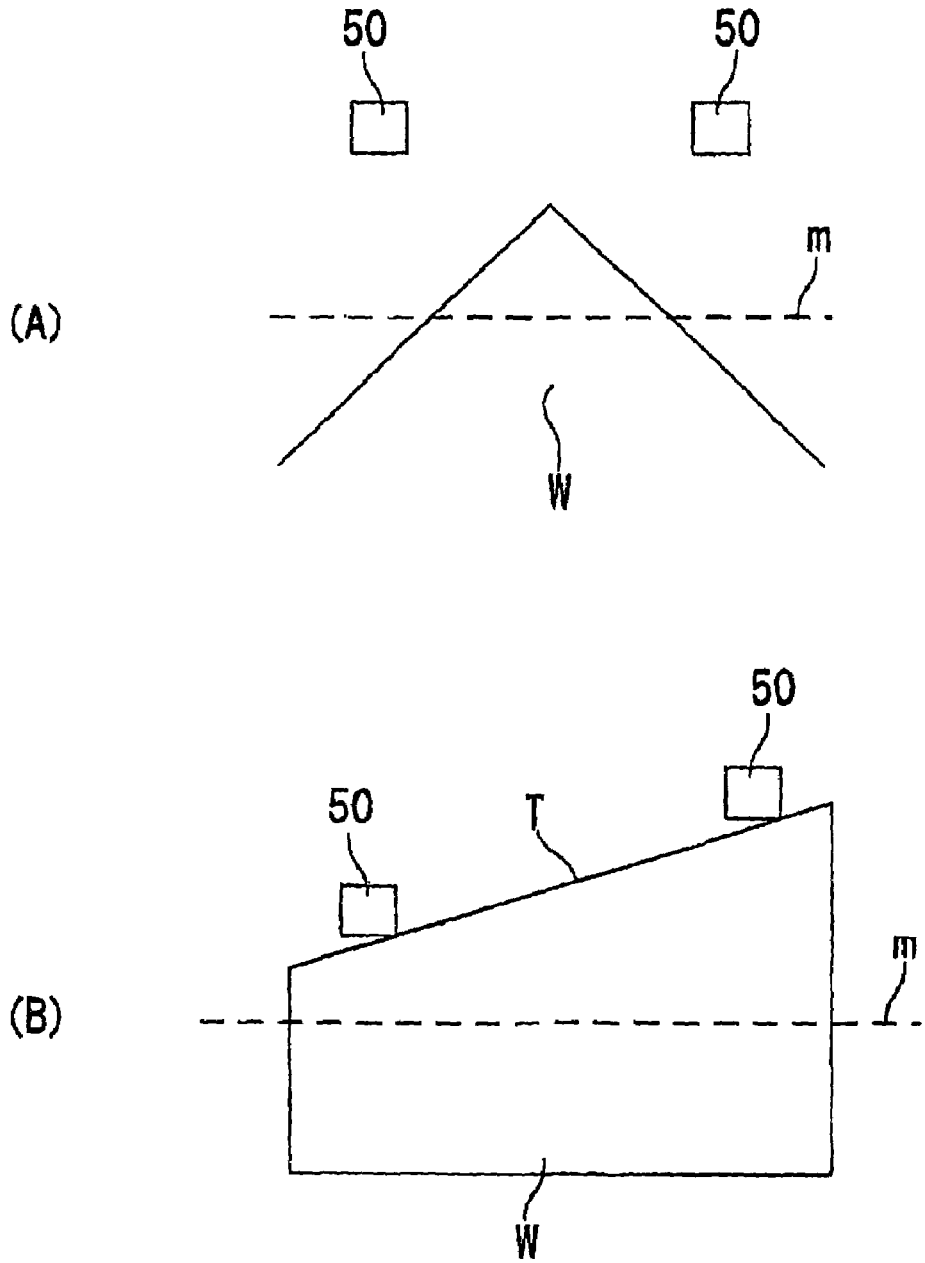
FIG. 26 are diagrams for, explaining another prior art.

Then, a human worker sets the positions $B_{R1}$ and $B_{R2}$ of the edges of the butting faces 15 and 16, and also sets the predetermined positions $A_{R1}$ and $A_{R2}$ on the end surface $T_R$ of the work image RW, by looking at this screen (step 202 in FIG. 23). In this case, as described above, the position of the longitudinal direction (X axis direction) of the work W is determined such that the left end of the work W is arranged at a position apart from a machine center MC by $X_1$. For example, in a state where the work W (FIG. 24 (A)) is supported by the gripper 14 of the robot 13, the left end of the work W is butted on the side gauge 18. If the position of the side gauge 18 at this time is assumed to be apart from the machine center MC by $X_S$, the left end of the work W can be arranged at the position apart from the machine center MC by $X_1$, by moving the robot 13 (FIG. 24(B)) by a predetermined distance $X_O=X_S-X_1$ to make a work origin O coincide with the machine center MC. Due to this, as will be described later, the positions of the forward/backward direction (Y axis direction) and leftward/rightward direction (X axis direction) of the work W are determined, thereby the position of the work W with respect to the bending machine 11 is determined uniquely.

In this case, the number of positions to be set may be at least one, or may be two with respect to, for example, the work origin O, as illustrated.

When the detection points are set in this manner, the reference distances $K_{R1}$ and $K_{R2}$ between the positions $B_{R1}$ and $B_{R2}$ of the edges of the butting faces 15 and 16 and predetermined positions $A_{R1}$ and $A_{R2}$ which are set as described above are automatically calculated by later-described reference distance calculating means 30E constituting the subordinate NC device 30 (FIG. 15) (step 203 in FIG. 23). As described above, the reference distances $K_{R1}$ and $K_{R2}$ are used by the distance difference calculating means 30F (FIG. 15) as the targets for calculating the distance differences $\Delta y_1$ and $\Delta y_2$ with respect to the detected distances $K_{D1}$ and $K_{D2}$ (FIG. 15).

In this case, the reference distances $K_{R1}$ and $K_{R2}$ may be input by a human worker manually. The positions $B_{R1}$ and $B_{R2}$ of the edges of the butting faces 15 and 16 (FIG. 18) and predetermined positions $A_{R1}$ and $A_{R2}$ on the work end surface $T_R$ which are set as described above are the detection points for detecting distances with respect to the butting faces 15 and 16 in positioning the work W, and also the detection points for detecting a distance with respect to the butting face 15 in measuring the, bending angle Θ, as will be described later.

Figure 22:
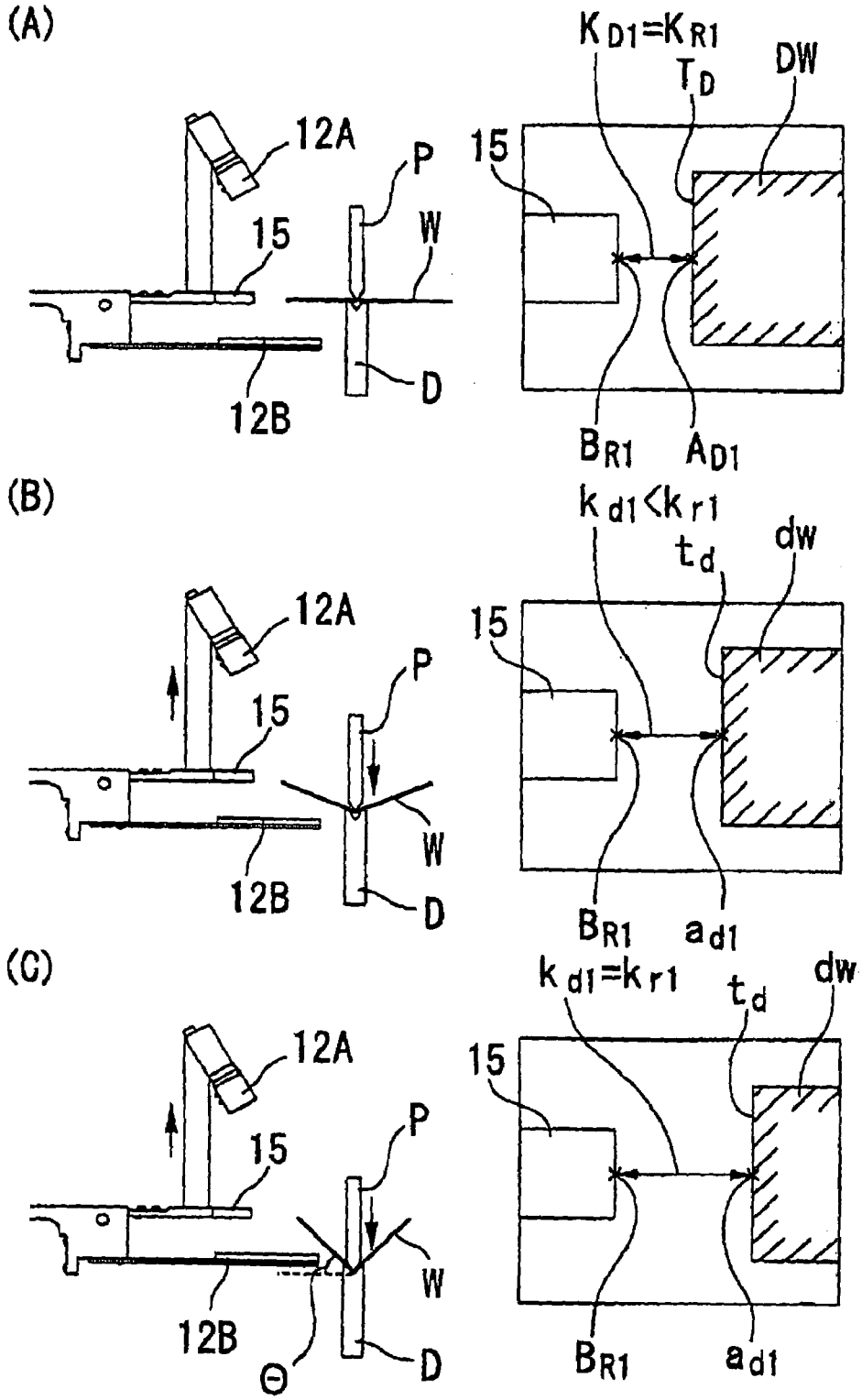
FIG. 22 are diagrams for explaining an operation according to the second embodiment of the present invention.

The operation of the second embodiment will be as illustrated in FIG. 22, by carrying out the positioning of the work W and the measuring of the bending angle Θ by using one device as described above.

In FIGS. 22(A), (B), and (C), the drawings on the left side show the positional relationship between the work W and the CCD camera 12A, and the drawings on the right side show the distance between the work image DW or dw which are image-processed via the CCD camera 12A and the butting face 15.

Among these drawings, the drawing on the right side of FIG. 22(A) shows a state where the distance $K_{D1}$ between the predetermined position $A_{D1}$ on the end surface $T_D$ of the work image DW and the position $B_{R1}$ of the edge of the butting face 15 becomes equal to the reference distance $K_{R1}$ and thereby the work positioning is completed. This drawing corresponds to FIG. 18.

The drawings on the right side of FIGS. 22(B) and (C) show a state where a distance $k_{d1}$ between a predetermined position $a_{d1}$ on an end surface $t_d$ of the work image dw and the position $B_{R1}$ of the edge of the butting face 15 changes after the punch P (the drawing on the left side of FIG. 22(B)) contacts the work W (after pinching point). These drawings correspond to FIG. 20.

In FIG. 22, after the positioning of the work W is completed (FIG. 22(A)), and then the punch P contacts the work W (FIG. 22(B)), the distance $k_{d1}$ with respect to the butting face 15 becomes larger as the bending operation progresses (the drawing on the right side of FIG. 22(B)).

At this time, the edges of the work W rise upward (the drawing on the left side of FIG. 22(B)). Therefore, the image dw of the work W is detected by raising the butting face 15 upward in response to the rising of the work W thereby to raise the CCD camera 12A.

When the punch P further drops downward (the drawing on the left side of FIG. 22 (C)) and the distance $k_{d1}$ (the drawing on the right side of FIG. 22(C)) with respect to the butting face 15 becomes equal to a predetermined distance $k_{r1}$, it is determined that the work W is bent to the predetermined bending angle Θ (the drawing on the left side of FIG. 22(C)), and the ram is stopped. Thus, the bending operation is completed.

The subordinate NC device 30 (FIG. 15), which is a control device for the press brake having the above-described structure, comprises a CPU 30A, information calculating means 30B, photographing control means 30C, distance detecting means 30D, reference distance calculating means 30E, distance difference calculating means 30F, robot control means 30G, bending control means 30H, and input/output means 30J.

The CPU 30A controls the information calculating means 30B, the distance detecting means 30D, etc. in accordance with an image processing program (corresponding to FIG. 23) of the present invention.

The information calculating means 30B calculates information necessary for the positioning of the work W and measuring of the bending angle Θ such as an order of bending and the shape of a product, etc. based on CAD information input from the superordinate NC device 29 via the input/output means 30J.

The photographing control means 30C moves the work photographing means 12 constituted by the CCD camera 12A and the light source 12B via the aforementioned moving mechanism for the butting faces 15 and 16 based on the information calculated by the information calculating means 30B, and controls the photographing operation such as the control of the view range (FIG. 16, FIG. 17) of the CCD camera 12A.

The distance detecting means 30D detects distances $K_{D1}$ and $K_{D2}$ between the positions $B_{R1}$ and $B_{R2}$ of the edges of the butting faces 15 and 16 and predetermined positions $A_{D1}$ and $A_{D2}$ on the work end surface $T_D$.

That is, as described above (FIG. 18), the positions $B_{R1}$ and $B_{R2}$ of the edges of the butting faces 15 and 16 which are set in advance on the screen are to be represented as below in two-dimensional coordinates.

$$\text{Positions of edges } B_{R1}(x_1,y_1'),B_{R2}(x_2,y_2') \quad [1]$$

The predetermined positions $A_{D1}$ and $A_{D2}$ on the end surface $T_D$ of the work image DW which are detected by the distance detecting means 30D (and existing on the extensions of the Y axis direction of the predetermined positions $A_{R1}$ and $A_{R2}$ which are set on the screen before by the human worker) are to be represented as below in two-dimensional coordinates.

$$\text{Predetermined positions } A_{D1}(X_1,y_1''),A_{D2}(x_2,y_2'') \quad [2]$$

Accordingly, the distances $K_{D1}$ and $K_{D2}$ with respect to the butting faces 15 and 16 can be represented as below based on the above [1] and [2].

$$K_{D1}=|B_{R1}-A_{D1}|=y_1'-y_1'' \quad [3]$$

$$K_{D2}=|B_{R2}-A_{D2}|=y_2'-y_2'' \quad [4]$$

These [3] and [4] are used by the distance difference calculating means 30F for calculating distance differences $\Delta y_1$ and $\Delta y_2$, as described above.

The reference distance calculating means 30E calculates reference distances $K_{R1}$ and $K_{R2}$ between the positions $B_{R1}$ and $B_{R2}$ of the edges of the butting faces and predetermined positions $A_{R1}$ and $A_{R2}$ on the work end surface $T_R$ which are set in advance, by image processing.

In this case, as described above (FIG. 18), the predetermined positions $A_{R1}$ and $A_{R2}$ on the end surface $T_R$ of the work image RW which are set in advance on the screen are to be represented as below in two-dimensional coordinates.

$$\text{Predetermined positions } A_{R1}(x_1,y_1), A_{R2}(x_2,y_2) \quad [5]$$

Accordingly, reference distances $K_{R1}$ and $K_{R2}$ can be represented as below based on [5] and the aforementioned [1] (based on the positions $B_{R1}$ and $B_{R2}$ of the edges of the butting faces 15 and 16).

$$K_{R1}=|B_{R1}-A_{R1}|=y_1'-y_1 \quad [6]$$

$$K_{R2}=|B_{R2}-A_{R2}|=y_2'-y_2 \quad [7]$$

These [6] and [7] are used by the distance difference calculating means 30F for calculating distance differences $\Delta y_1$ and $\Delta y_2$.

The distance difference calculating means 30F compares the detected distances $K_{D1}$ and $K_{D2}$ represented by the above [3] and [4] with the reference distances $K_{R1}$ and $K_{R2}$ represented by [6] and [7], and calculates the distance differences $\Delta y_1$ and $\Delta y_2$ between them.

That is, the distance difference $\Delta y_1$ is as follows.

$$\Delta y_1=K_{D1}-K_{R1}=(y_1'-y_1'')-(y_1'-y_1)=y_1-y_1'' \quad [8]$$

The distance difference $\Delta y_2$ is as follows.

$$\Delta y_2=K_{D2}-K_{R2}=(y_2'-y_2'')-(y_2'-y_2)=y_2-y_2'' \quad [9]$$

The robot control means 30G (FIG. 15) controls the robot 13 such that the detected distances $K_{D1}$ and $K_{D2}$ and the reference distances $K_{R1}$ and $K_{R2}$ become equal based on the distance differences $\Delta y_1$ and $\Delta y_2$ represented by the above [8] and [9], thereby positioning the work W at a predetermined position.

That is, when the robot control means 30G receives the distance differences $\Delta y_1$ and $\Delta y_2$ from the distance difference calculating means 30F, the robot control means 30G converts these into correction drive signals $S_a$, $S_b$, $S_c$, $S_d$, and $S_e$ and sends each signal to the robot 13.

The robot 13 actuates drive units a, b, c, d, and e constituting the robot 13 in accordance with the signals, thereby moving the work W supported by the gripper 14 in the Y axis direction by the distance differences $\Delta y_1$ and $\Delta y_2$ (FIG. 18).

Therefore, a control for making the detected distances $K_{D1}$ and $K_{D2}$ and the reference distances $K_{R1}$ and $K_{R2}$ become equal is performed, and the work W can be positioned at a predetermined position.

The bending control means 30H (FIG. 15) controls the press brake based on the order of bending, etc. determined by the information calculating means 10B and carries out the bending operation by the punch P and die D on the work W as positioned.

The input/output means 10J comprises a keyboard and a screen constituted by liquid crystal or the like. For example, as described above, a human worker sets the positions $B_{R1}$ and $B_{R2}$ of the edges of the butting faces 15 and 16 (FIG. 18), and also sets the predetermined positions $A_{R1}$ and $A_{R2}$ on the end surface $T_R$ of the work image RW which is obtained based on CAD information (step 202 in FIG. 23) by seeing the screen.

Figure 19:
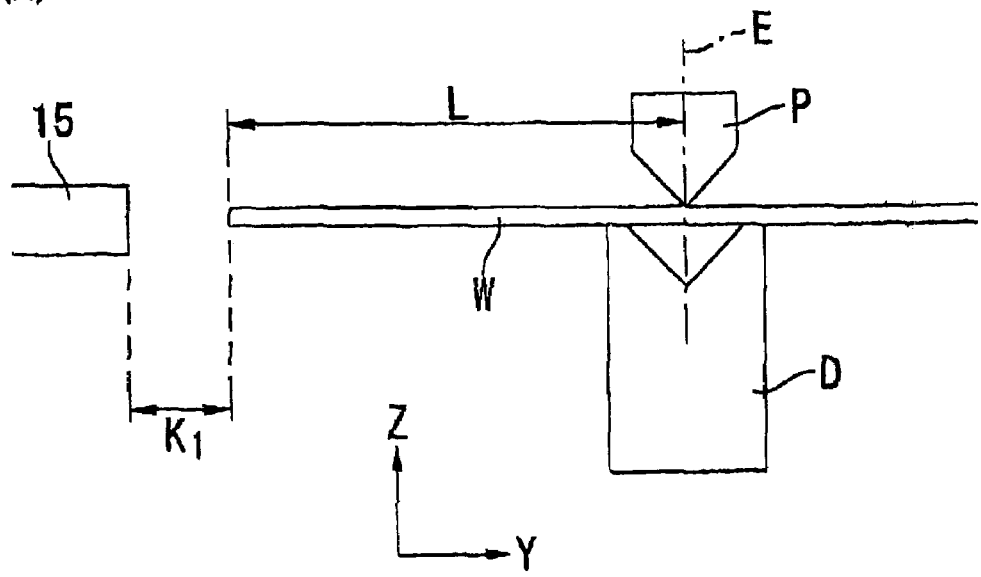
Figure 19:
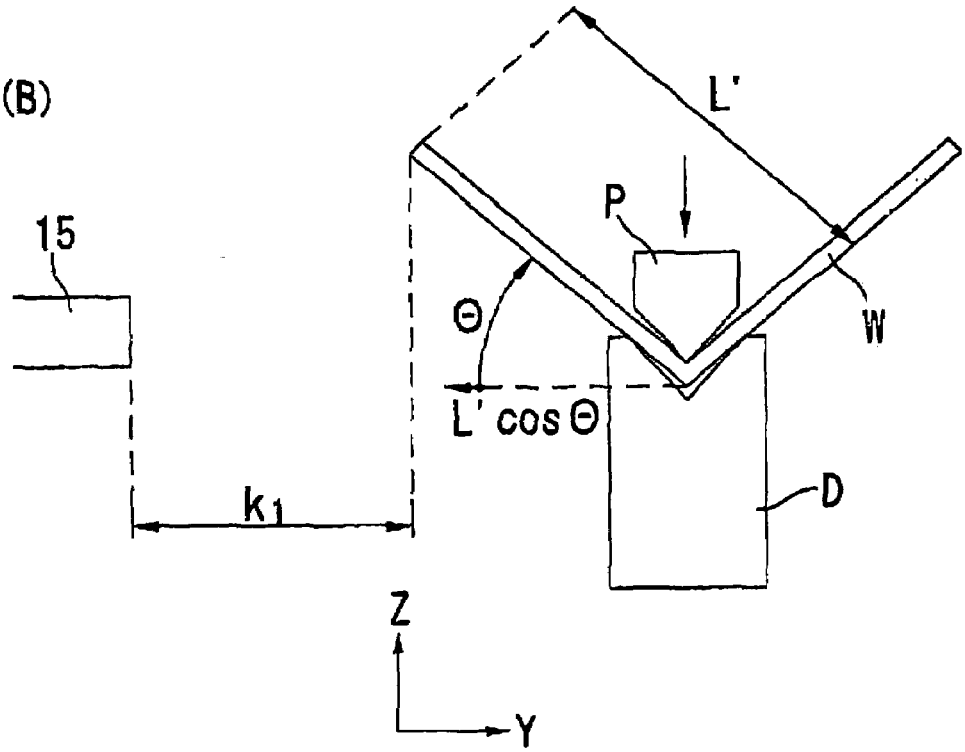
Figure 20:
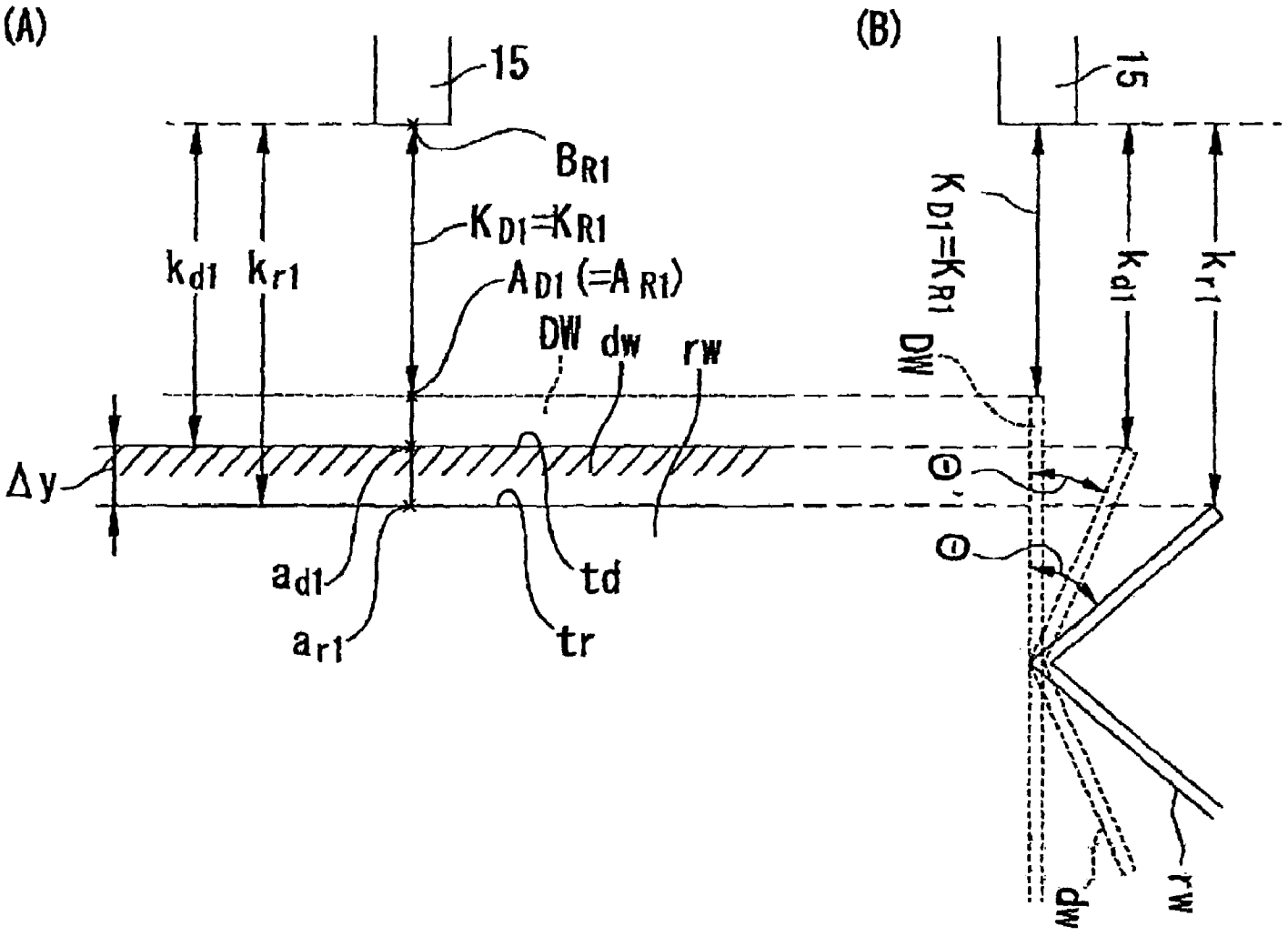
FIG. 20 are diagrams showing image processing in FIG. 19.

Further, the distance detecting means 30D, the reference distance calculating means 30E, and the distance difference calculating means 30F perform the following operation in case of measuring the bending angle Θ (FIG. 19, FIG. 20).

That is, let it be assumed that the distance between one butting face 15 and the work W at the time the positioning of the work W (FIG. 19(A)) is completed is $K_1$, and the distance at this time between the edge of the work W and the center E of a mold is L.

Further, let it be assumed that the distance between the butting face 15 and the work W when the work W is bent to a predetermined bending angle Θ after the bending operation is started (FIG. 19(B)) and the punch P contacts the work W (after pinching point) is $k_1$, and a flange dimension L' at this time is represented by $L'=L+\alpha$ in consideration of unilateral elongation α which is calculated in advance by the information calculating means 30B. In this case, the following equation is established.

$$k_1=L-L'\times\cos\Theta+K_1 \quad [10]$$

The bending angle Θ can be represented by the following equation based on [10].

$$\Theta=\cos^{-1}\{(L+K_1-k_1)/L'\} \quad [11]$$

Accordingly, as apparent from [11], the distance $k_1$ between the butting face 15 and the work W after the punch P contacts the work W and the bending angle Θ are related with each other in one-to-one correspondence because L, $K_1$ and L' are constants. Therefore, the bending angle Θ is indirectly measured by detecting $k_1$.

From this aspect, the reference distance calculating means 30E (FIG. 15) receives the bending angle Θ calculated by the information calculating means 30B based on the CAD information, and calculates the following bending reference distance $k_{r1}$ (FIG. 20 (A)).

$$k_{r1}=L-L'\times\cos\Theta+K_{R1} \quad [12]$$

This bending reference distance $k_{r1}$ is a distance between a predetermined position a predetermined position $a_{r1}$ on an end surface $t_r$ of a work image rw (FIG. 20(A)) based on CAD information and the previously set position $B_{R1}$ of the edge of the butting face 15 in case of the work W being bent to the predetermined angle Θ.

Accordingly, after pinching point (step 210 in FIG. 23), in a case where a bending detected distance $k_{d1}$ (FIG. 20(A)) which is a distance between the butting face 15 and the work W detected by image processing (step 211 in FIG. 23) coincides with the bending reference distance $k_{r1}$ (step 212 in FIG. 23: YES), the distance detecting means 30D (FIG. 15) determines that the work W has been bent to the predetermined angle Θ, and stops the ram via the bending control means 30H (FIG. 15) (step 213 in FIG. 23), thereby completing the bending operation.

The bending detected distance $k_{d1}$ is a distance between a predetermined position $a_{d1}$ on an end surface $t_d$ of a work image dw (FIG. 20(B)) which is input from the CCD camera 12A after pinching point (step 210 in FIG. 23: YES) and the previously set position $B_{R1}$ of the edge of the butting face 15.

While the work W is being bent, the distance difference calculating means 30F (FIG. 15) constantly monitors the bending detected distance $k_{d1}$ detected by the distance detecting means 30D to compare it with the bending reference distance $k_{r1}$ calculated by the reference distance calculating means 30E and calculate a distance difference Δy (FIG. 20(A)). In a case where it is determined that Δy=0 is satisfied and the both coincide with each other (step 212 in FIG. 23: YES), the ram is stopped via the bending control means 30H (FIG. 15) (step 213 in FIG. 23), as described above.

However, in a case where Δy≠0 (step 212 in FIG. 23: NO) and the work W can not be bent to the bending angle Θ, for example, in case of a bending angle Θ' (FIG. 20(B)), i.e. in case of a bending angle being smaller than required, the ram is lowered further via the bending control means 30H (FIG. 15), thereby adjusting the position of the ram (step 214 in FIG. 23).

The operation according to the second embodiment of the present invention having the above-described structure will now be explained based on FIG. 23.

(1) Controlling Operation for Positioning of the Work W

CAD information is input in step 201 of FIG. 23, detection points are set in step 202, reference distances are calculated in step 203, and the butting faces are moved to the set positions in step 204.

That is, when CAD information is input from the superordinate NC device 29 (FIG. 15) to the subordinate NC device 30, a work image RW (FIG. 18) as a development is displayed on the screen of the input/output means 30J (FIG. 15). By seeing this screen, a human worker sets the positions $B_{R1}$ and $B_{R2}$ of the edges of the butting faces 15 and 16 as the detection points, and also sets the predetermined positions $A_{R1}$ and $A_{R2}$ on the end surface $T_R$ of the work image RW which is based on the CAD information. At this time, as described above, by butting the left end (FIG. 24(A)) of the work W on the side gauge 18, the work W is positioned in the X axis direction such that the left end (FIG. 24(B)) is arranged to be apart from the machine center MC by $X_1$.

When the detection points are set, each detection point is sent to the reference distance calculating means 30E via the information calculating means 30B (FIG. 15).

Then, reference distances $K_{R1}$ and $K_{R2}$ between the positions $B_{R1}$ and $B_{R2}$ of the edges of the butting faces 15 and 16 and predetermined positions $A_{R1}$ and $A_{R2}$ on the work end surface $T_R$ which are set earlier are calculated by the reference distance calculating means 30E (FIG. 15) in accordance with [6] and [7] described above.

Further, in this case, the reference distance calculating means 30E calculates not only the reference distances $K_{R1}$ and $K_{R2}$ for positioning, but also the bending reference distance $k_{r1}$ for the bending operation in accordance with [12] described above, When the reference distances $K_{R1}$, $K_{R2}$, and $k_{d1}$ are calculated in this manner, the CPU 30A (FIG. 15) instructs the bending control means 30H to move the butting faces 15 and 16 to the positions $B_{R1}$ and $B_{R2}$ (FIG. 18) of the edges of the butting faces 15 and 16 which are set earlier.

In this state, positioning of the work W by the robot 13 is carried out in step 205 of FIG. 23, distances from the butting faces are detected in step 206, and whether they are predetermined distances or not is determined in step 207. In a case where they are not the predetermined distances (NO), the flow returns to step 205 to repeat the same operation, In a case where they are the predetermined distances (YES), positioning of the work W is completed in step 208.

That is, when the CPU 30A (FIG. 15) detects that the butting faces 15 and 16 are moved to the set edge positions $B_{R1}$ and $B_{R2}$ (FIG. 18), the CPU 30A drives the robot 13, this time via the robot control means 30G (FIG. 15). At the same time, the CPU 30A moves the butting faces 15 and 16 via the bending control means 30H, so that the CCD camera 12A and its light source 12B which are attached to the butting face are moved to photograph the work W supported by the gripper 14 of the robot 13.

The photographed image of the work W is sent to the distance detecting means 30D. Based on the sent work image DW (FIG. 18), the distance detecting means 30D detects distances $K_{D1}$ and $K_{D2}$ between the positions $B_{R1}$ and $B_{R2}$ of the edges of the butting faces 15 and 16 and predetermined positions $A_{D1}$ and $A_{D2}$ on a work end surface $T_D$ in accordance with [3] ad [4] described above.

The detected distances $K_{D1}$ and $K_{D2}$ and the reference distances $K_{R1}$ and $K_{R2}$ calculated by the reference distance calculating means 30E are sent to the distance difference calculating means 30F for the next step, and distance differences $\Delta y_1$ and $\Delta y_2$ between them are calculated in accordance with [8] and [9] described above.

Due to this, the robot control means 30G converts the distance differences $\Delta y_1$ and $\Delta y_2$ into correction drive signals $S_a$, $S_b$, $S_c$, $S_d$, and $S_e$, and sends these signals to the robot 13 to control the drive units a, b, c, d, and e of the robot 13 such that the detected distances $K_{D1}$ and $K_{D2}$ (FIG. 18) and the reference distances $K_{R1}$ and $K_{R2}$ coincide with each other, thereby positioning the work W at a predetermined position.

If positioning of the work W by the robot 13 is carried out in this manner and the detected distances $K_{D1}$ and $K_{D2}$ and the reference distances $K_{R1}$ and $K_{R2}$ coincide, positioning of the work W is completed.

(2) Controlling Operation for Bending Operation

When the positioning of the work W is completed, the ram is lowered in step 209 of FIG. 23, and whether the punch P contacts the work W or not is determined in step 210. In a case where the punch P does not contact (NO), the flow returns to step 209 to repeat the same operation. In a case where the punch P contacts (YES), distances from the butting faces are detected in step 211. Then, whether they are predetermined distances or not is determined in step 212. In a case where they are not the predetermined distances (NO), the position of the ram is adjusted in step 214. In a case where they are the predetermined distances (YES), the ram is stopped and the bending operation is completed in step 213.

That is, when the CPU 30A (FIG. 15) detects via the robot control means 30G that the positioning of the work W is completed, the CPU 30A lowers the ram, or the upper table 20 in case of, for example, a lowering type press brake, via the bending control means 30H this time.

Then, the CPU 30A detects the position of the ram 20 via ram position detecting means or the like. In a case where it is determined that the punch P contacts the work W, the CPU 30A then moves the butting face 15 via the bending control means 30H so that the CCD camera 12A and its light source 12B are moved to photograph the work W, and controls the distance detecting means 30D to detect a bending distance $k_{d1}$ with respect to the butting face 15 based on the photographed image dw (FIG. 20(A)) of the work W.

This bending detected distance $k_{d1}$ is sent to the distance difference calculating means 30F. The distance difference calculating means 30F calculates a distance difference $\Delta y$ with respect to the bending reference distance $k_{r1}$ calculated by the reference distance calculating means 30E. In a case where $\Delta y=0$ is satisfied and the bending detected distance $k_{d1}$ and the bending reference distance $k_{r1}$ coincide with each other, it is determined that the work W has been bent to the predetermined bending angle $\Theta$ (FIG. 20(B)). Therefore, lowering of the ram 20 is stopped via the bending control means 30H, and the bending operation is completed.

INDUSTRIAL APPLICABILITY

As described above, the bending machine according to the present invention can position a work accurately by carrying out electronic positioning by using image processing, even in a case where mechanical positioning by using butting faces is impossible.

Further, if a corner of a work is used as a target of comparison in a case where a detected image and a reference image are compared by image processing, the amount of difference between both of the images can be corrected at one time by photographing either one of the corners by using one CCD camera Therefore, it is possible to improve the efficiency of operation including positioning of the work. By carrying out the work positioning control operation and the bending control operation by one device, the system can be simplified. Attaching of the work photographing means to the butting face eliminates the need of providing a special moving mechanism, thereby enabling cost cut.

The invention claimed is:

1. A work positioning device, comprising:

an image processor that processes images from which measured values are obtained, so that a work is positioned at a predetermined position such that a measured value coincides with a reference value relating to the predetermined position; and a mobile camera that is guidable in a predetermined direction and that captures the images from which the measured values are obtained.

2. The work positioning device according to claim 1, wherein said mobile camera is guidable in a plurality of predetermined directions.

3. The work positioning device according to claim 1, further comprising:

a light source that is guidable in the predetermined direction, wherein movement of said mobile camera and said light source is synchronized.

4. The work positioning device according to claim 1, wherein the image processor is configured to obtain the reference value from a processed image by utilizing the hole formed in the reference work and a work positioning mark provided on the work.

5. The work positioning device according to claim 1, wherein the image processor processes images from which measured values are obtained by using a work positioning mark corresponding to the work, and a reference positioning mark corresponding to a reference work corresponding to reference image.

6. The work positioning device according to claim 5, wherein the work positioning mark comprises a hole formed in the work at a predetermined position.

7. The work positioning device according to claim 1, wherein the reference value is generated using side stoppers, the side stoppers being provided on the work positioning device and configured to abut a reference work so as to mark an outline of the reference work corresponding to a reference image, and wherein image data of the outline of the work is generated using at least one check area which is predetermined based on the reference image.

8. A work positioning device, comprising:

an image processor that processes images from which measured values are obtained, so that a work is positioned at a predetermined position such that a measured value coincides with a reference value corresponding to the predetermined position, wherein image data of an outline of the work is generated using at least one checker which provides a check area configured to detect image data, the check area being based on a reference image from which the reference value is obtained.

9. The work positioning device according to claim 8, wherein the image processor processes images from which measured values are obtained, the working positioning device further comprising a calculator which compares a work outline corresponding to the work to a reference outline corresponding to the reference image so that a compared result is obtained, the compared result being used to calculate an amount of difference between the corresponding work outline and the corresponding reference outline.

10. The work positioning device according to claim 8, wherein the reference value is generated using side stoppers, the side stoppers being provided on the work positioning device and configured to abut a reference work so as to mark an outline of the reference work corresponding to the reference image.

* * * * *